US009848259B2

(12) United States Patent
Lee et al.

(10) Patent No.: US 9,848,259 B2
(45) Date of Patent: Dec. 19, 2017

(54) LOUDSPEAKER

(71) Applicant: SAMSUNG ELECTRONICS CO., LTD., Suwon-si, Gyeonggi-do (KR)

(72) Inventors: Gyeong-tae Lee, Seoul (KR); Jong-bae Kim, Seoul (KR); Dong-kyu Park, Hwaseong-si (KR); Sung-ha Son, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 15/010,272

(22) Filed: Jan. 29, 2016

(65) Prior Publication Data

US 2017/0055069 A1 Feb. 23, 2017

(30) Foreign Application Priority Data

Aug. 18, 2015 (KR) ..... 10-2015-0116105

(51) Int. Cl.

| | |
|---|---|
| ***H04R 1/28*** | (2006.01) |
| ***H04R 1/02*** | (2006.01) |
| ***H04R 1/40*** | (2006.01) |
| ***H04R 1/32*** | (2006.01) |

(52) U.S. Cl.

CPC ..... *H04R 1/2896* (2013.01); *H04R 1/02* (2013.01); *H04R 1/2826* (2013.01); *H04R 1/2838* (2013.01); *H04R 1/2853* (2013.01); *H04R 1/2869* (2013.01); *H04R 1/323* (2013.01); *H04R 1/403* (2013.01); *H04R 2209/027* (2013.01); *H04R 2499/15* (2013.01)

(58) Field of Classification Search

CPC ..... H04R 1/00; H04R 2205/022; H04R 2201/401; H04R 2201/405; H04R 1/28

USPC ..... 381/346–347, 350–351, 182

See application file for complete search history.

(56) References Cited

U.S. PATENT DOCUMENTS 4,944,019 A * 7/1990 Watanabe ..... H04R 1/2842 181/199

5,590,208 A * 12/1996 Koyano ..... H04R 1/2842 181/156

(Continued)

FOREIGN PATENT DOCUMENTS

EP 1 370 110 12/2003

EP 10-2017-0021562 A 2/2017

(Continued)

OTHER PUBLICATIONS

Extended Search Report dated Jan. 5, 2017 in counterpart European Patent Application No. 16158076.6.

(Continued)

*Primary Examiner* — Suhan Ni

(74) *Attorney, Agent, or Firm* — Nixon & Vanderhye P.C.

(57) ABSTRACT

A loudspeaker includes an enclosure including a resonance chamber and an acoustic emission aperture for communication of the resonance chamber with the outside, and a plurality of speaker units including a first speaker unit arranged in a first direction and a second speaker unit arranged in a second direction, and the plurality of speakers being accommodated in the enclosure in a non-coaxial arrangement. Front slit spaces of the plurality of speaker units are in communication with the resonance chamber.

20 Claims, 22 Drawing Sheets

(56) References Cited

U.S. PATENT DOCUMENTS

| | | | | |
|---|---|---|---|---|
| 5,895,896 | A * | 4/1999 | Alton, Jr. | H04R 1/2842 181/145 |
| 6,744,902 | B2 * | 6/2004 | Proni | H04R 1/02 381/345 |
| 7,463,746 | B2 * | 12/2008 | Caron | H04R 1/345 381/350 |
| 8,014,545 | B2 * | 9/2011 | Grant | H04R 1/025 381/182 |
| 8,351,631 | B2 | 1/2013 | Lee et al. | |
| 2002/0061114 | A1 * | 5/2002 | Croft, III | H04R 1/2842 381/345 |
| 2006/0062402 | A1 * | 3/2006 | Heil | H04R 1/345 381/182 |
| 2014/0314249 | A1 | 10/2014 | Fincham | |
| 2017/0055069 | A1 | 2/2017 | Lee et al. | |

FOREIGN PATENT DOCUMENTS

| | | |
|---|---|---|
| WO | 2011/039842 | 4/2011 |
| WO | WO 2014/164573 | 10/2014 |

OTHER PUBLICATIONS

EP Intention to Grant (NOA) of Application No. EP 16158076.6 dated Sep. 21, 2017.

* cited by examiner

LOUDSPEAKER

CROSS-REFERENCE TO RELATED APPLICATION

This application is based on and claims priority under 35 U.S.C. §119 to Korean Patent Application No. 10-2015-0116105, filed on Aug. 18, 2015, in the Korean Intellectual Property Office, the disclosure of which is incorporated by reference herein in its entirety.

BACKGROUND

1. Field

The disclosure relates to loudspeakers for reproducing sound using an electrical signal.

2. Description of Related Art

The power of sound generated by a loudspeaker may be defined as the product between the square of the volume velocity of a medium (e.g., air) that moves due to vibration of a diaphragm and a radiation resistance caused by the shape of the diaphragm and the medium.

The volume velocity is proportional to the product of the area and dynamic range of the diaphragm. The volume velocity is determined by the dynamic range of the diaphragm when the fixed area of the diaphragm is considered. The radiation resistance corresponds to a real number of a radiation impedance of the diaphragm and is a physical quantity that directly contributes to acoustic power, which is effective power. The radiation resistance of a loudspeaker that includes a disc type driver installed on an infinite baffle decreases remarkably in a low-frequency band.

A woofer is designed to mainly reproduce sound in a low frequency band and is thus required to have a high volume velocity so as to reproduce sound at a desired level regardless of a low radiation resistance at a low frequency band. Thus, the woofer is required to have a much larger diaphragm area and dynamic range than a mid-range speaker or a tweeter. The volume of an enclosure should be increased to increase the area of the diaphragm of the woofer and maintain a low-frequency reproduction limit. Thus, it is difficult to manufacture the woofer of a slim type.

If increasing the volume of the enclosure is restricted, the dynamic range of the diaphragm may be increased to achieve a high volume velocity. When the dynamic range of the diaphragm is increased, a high volume velocity may be achieved, but the vibration energy increases and an electronic device in which the woofer is installed and peripheral structures may vibrate unnecessarily.

SUMMARY

A loudspeaker with increased degree of freedom of an acoustic emission direction is provided.

A loudspeaker with reduced decrease of an output sound level is provided.

A loudspeaker with reduced vibration is provided.

A loudspeaker with improved sound articulation is provided.

Additional aspects will be set forth in part in the description which follows and, in part, will be apparent from the description.

According to an aspect of an example embodiment, a loudspeaker includes an enclosure including a resonance chamber and a main acoustic emission aperture for communication of the resonance chamber with an outside of the enclosure; and a plurality of speaker units, each speaker unit including a speaker, the plurality of speaker units including a first speaker unit arranged in a first direction and a second speaker unit arranged in a second direction, the plurality of speaker units being accommodated in the enclosure in a non-coaxial arrangement, wherein front slit spaces of the plurality of speaker units are in communication with the resonance chamber.

The plurality of speaker units may be arranged in a non-coaxial force-moment compensation arrangement.

The enclosure may include a first baffle in which the first speaker unit is arranged; and a second baffle in which the second speaker unit is arranged. The first baffle and the second baffle may form a step with respect to each other in a first direction.

The loudspeaker may further include a duct configured to connect the resonance chamber to the main acoustic emission aperture.

The loudspeaker may further include a passive radiator arranged in the main acoustic emission aperture.

The loudspeaker may further include an attenuator arranged in a plurality of communication apertures connecting the front slit spaces and the resonance chamber and configured to apply an acoustic resistance.

At least two back chambers from among back chambers of the plurality of speaker units may be arranged to communicate with each other.

Each of back chambers of the plurality of speaker units may have a sealed enclosure structure, a vented enclosure structure, or a passive radiator type enclosure structure.

The plurality of speaker units may be divided into a first speaker group arranged at one side of the resonance chamber and a second speaker group arranged at another side of the resonance chamber. Back chambers of the first speaker group may communicate with one another, and back chambers of the second speaker group may communicate with one another.

The loudspeaker may further include first and second acoustic emission apertures in communication with the main acoustic emission aperture. The resonance chamber may include first and second resonance chambers, and the plurality of speaker units may include a first speaker group including front slit spaces in communication with the first resonance chamber; and a second speaker group including front slit spaces in communication with the second resonance chamber. Back chambers of the first speaker group may communicate with one another, and back chambers of the second speaker group may communicate with one another. The enclosure may further include an additional chamber configured to communicate with back chambers of the first and second speaker groups.

According to an aspect of another example embodiment, a loudspeaker includes a plurality of speaker units arranged in a non-coaxial structure; and an enclosure configured to accommodate the plurality of speaker units. The enclosure includes an acoustic emission aperture; and a band-pass amplifier configured to communicate with front slit spaces of the plurality of speaker units, to band-pass amplify a sound emitted from the plurality of speaker units, and to emit the sound via the acoustic emission aperture.

The band-pass amplifier may include a resonance chamber configured to communicate with the front slit spaces; and a duct configured to connect the resonance chamber and the acoustic emission aperture.

The band-pass amplifier may include a resonance chamber configured to communicate with the front slit spaces and the acoustic emission aperture; and a passive radiator installed in the acoustic emission aperture.

The plurality of speaker units may be arranged in a non-coaxial force-moment compensation arrangement.

The loudspeaker may further include an attenuator arranged in a plurality of communication apertures connecting the front slit spaces and the resonance chamber and configured to apply an acoustic resistance.

At least two back chambers from among back chambers of the plurality of speaker units may communicate with each other.

The enclosure may further include an additional chamber configured to communicate with back chambers of the plurality of speaker units.

BRIEF DESCRIPTION OF THE DRAWINGS

These and/or other aspects will become apparent and more readily appreciated from the following detailed description, taken in conjunction with the accompanying drawings, in which like reference numerals refer to like elements, and wherein.

DETAILED DESCRIPTION

Figure 1:
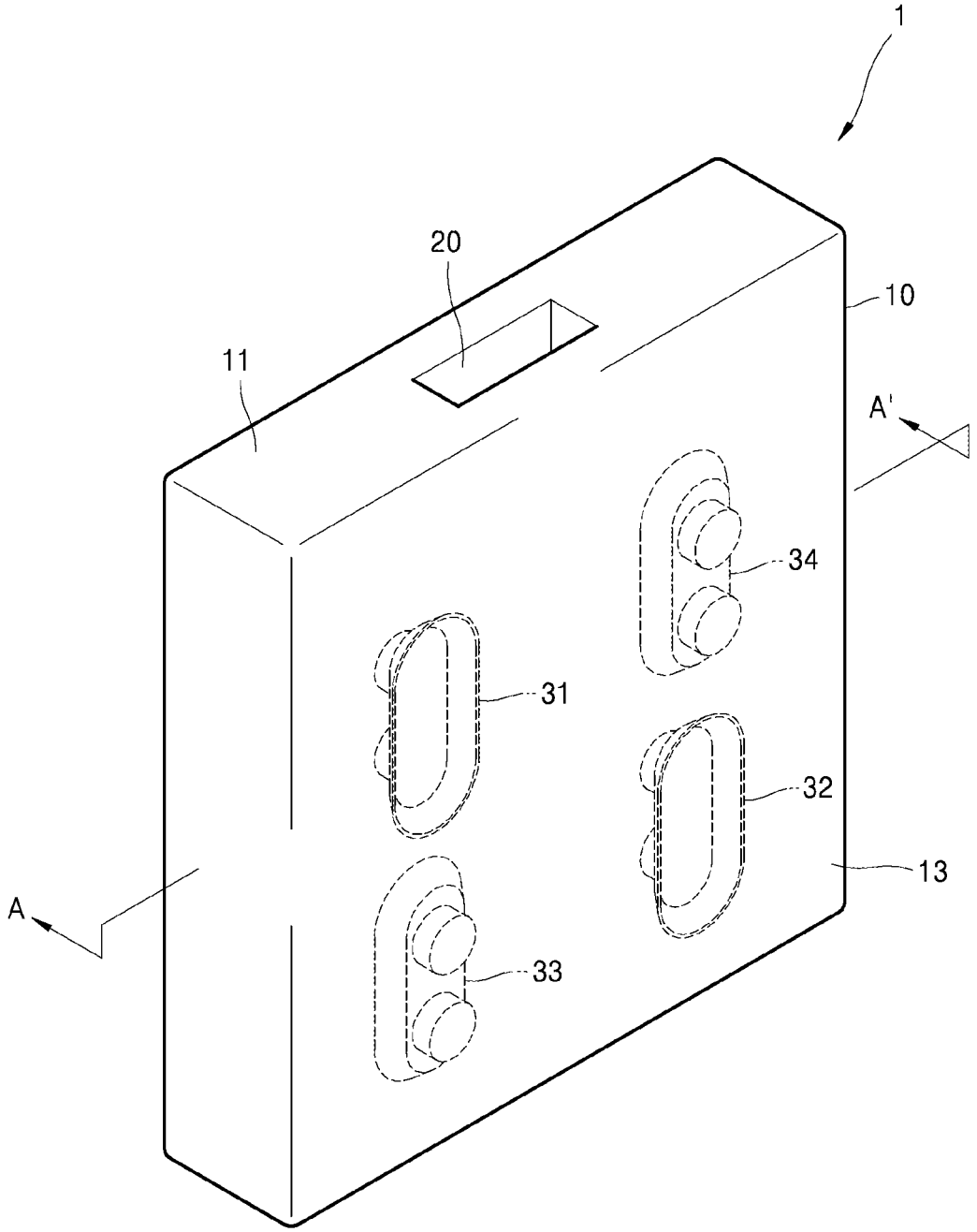
FIG. 1 is a perspective view illustrating an example loudspeaker.

Hereinafter, loudspeakers according to example embodiments will be described in greater detail with reference to the accompanying drawings. In the drawings, like reference numerals refer to like elements throughout and the sizes or thicknesses of components may be exaggerated for clarity. As used herein, expressions such as 'at least one of,' when preceding a list of elements, modify the entire list of elements and do not necessarily modify the individual elements of the list.

Figure 2:
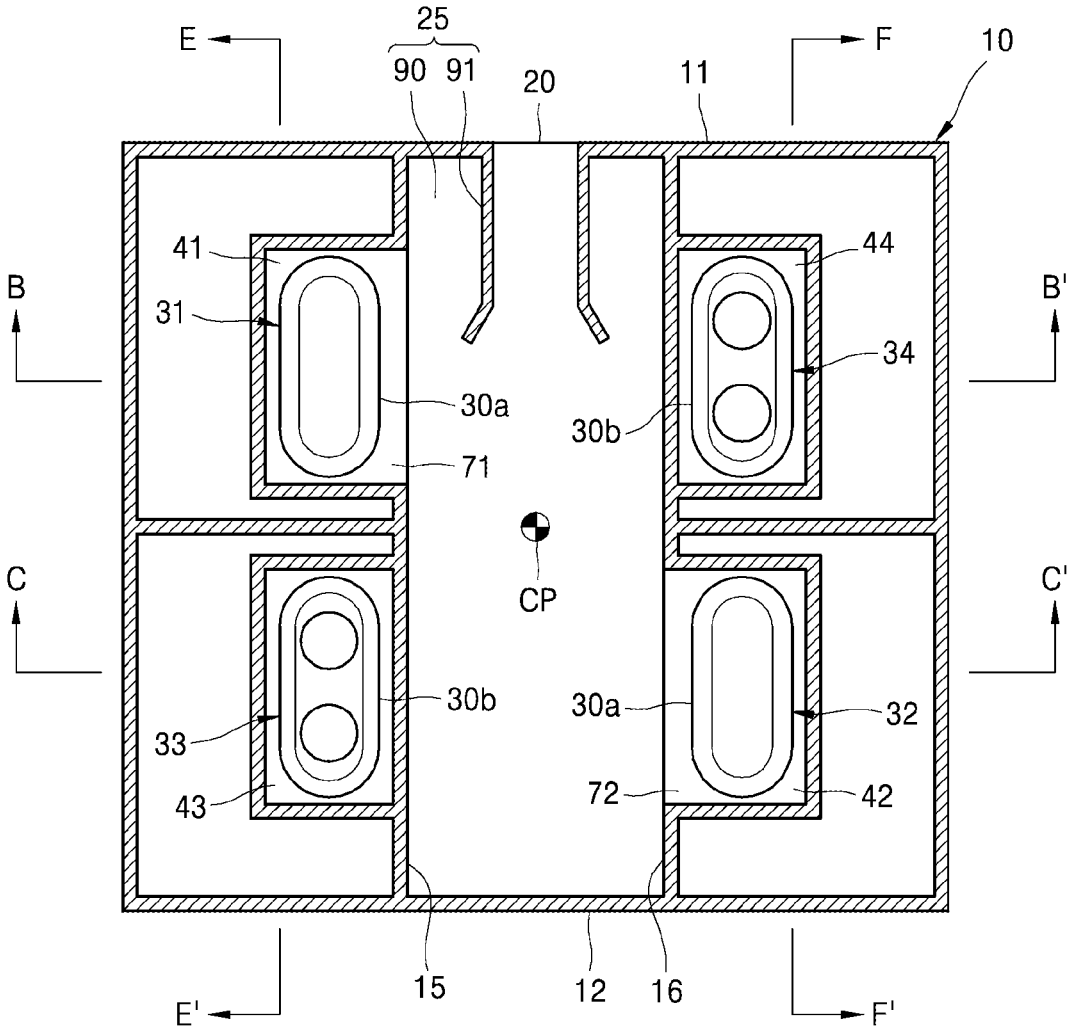
FIG. 2 is a cross-sectional view of FIG. 1, taken along line A-A'.
Figure 3:
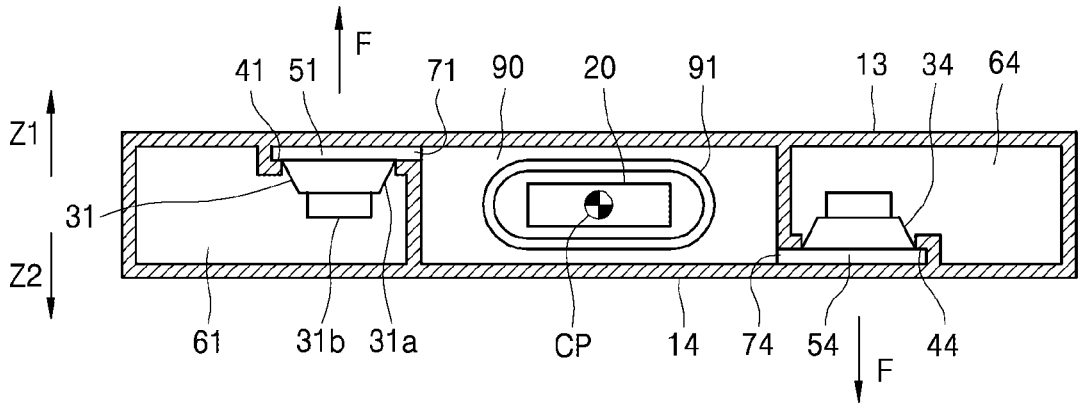
FIG. 3 is a cross-sectional view of FIG. 2, taken along line B-B'.
Figure 4:
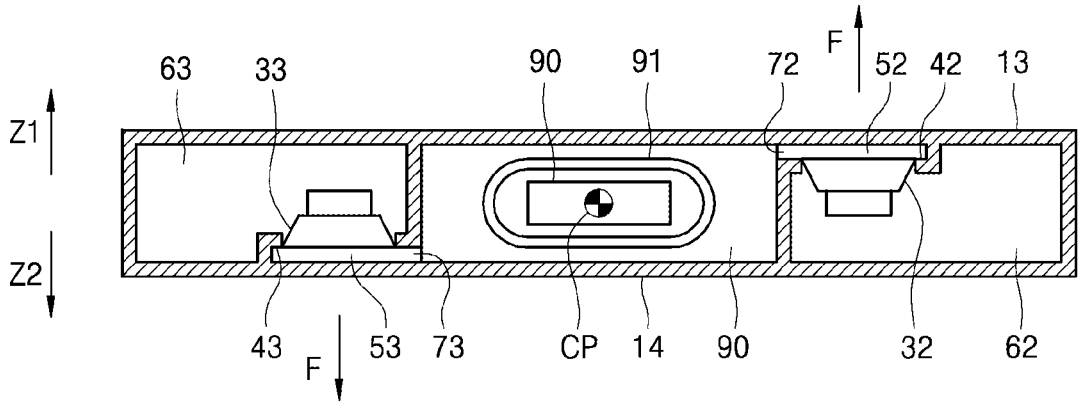
FIG. 4 is a cross-sectional view of FIG. 2, taken along line C-C'.

FIG. 1 is a perspective view illustrating an example loudspeaker 1. FIG. 2 is a cross-sectional view of FIG. 1, taken along line A-A'. FIG. 3 is a cross-sectional view of FIG. 2, taken along line B-B'. FIG. 4 is a cross-sectional view of FIG. 2, taken along line C-C'.

Referring to FIGS. 1 to 4, the loudspeaker 1 includes an enclosure 10 and four speaker units 31 to 34 arranged in the enclosure 10. An acoustic emission aperture 20 may be provided in the enclosure 10. The position and direction of the acoustic emission aperture 20 are not limited. In the example embodiment, the acoustic emission aperture 20 is provided in an upper wall 11 of the enclosure 10. The loudspeaker 1 according to the example embodiment may include a band-pass amplifier 25 configured to band-pass amplify the sound emitted from the four speaker units 31 to 34 and emit the sound via the acoustic emission aperture 20. According to an example embodiment, the band-pass amplifier 25 may include a resonance chamber 90, and a duct 91 connecting the resonance chamber 90 and the acoustic emission aperture 20 to each other.

Each of the speaker units 31 to 34 includes a diaphragm 31*a* and a motor 31*b* for driving the diaphragm 31*a*. Although not shown, the motor 31*b* may, for example, include a stator and an oscillator. The motor 31*b* may, for example, employ either a moving coil manner using a magnet as a stator and a coil as an oscillator or a moving magnetic manner using a coil as a stator and a magnet as an oscillator. The shape of the diaphragm 31*a* is not limited to those illustrated in FIGS. 2 to 4. The diaphragm 31*a* may have various shapes provided that an area sufficient to obtain a desired acoustic power level can be secured. For example, the diaphragm 31*a* may have a round, oval, quadrangle shape, etc. Although a structure in which one diaphragm 31*a* is driven using two motors 31*b* is illustrated in the example embodiments of FIGS. 2 to 4, the number of the motors 31*b* is not limited and one or three or more motors 31*b* may be used in some cases.

The speaker units 31 to 34 are accommodated in the enclosure 10. In the enclosure 10, baffles 41 to 44 in which the speaker units 31 to 34 are respectively disposed are provided. The speaker units 31 and 32 (e.g., including a first speaker unit 30*a*) are installed in the baffles (first baffle) 41 and 42 in a first direction Z1, e.g., to face a front wall 13 of the enclosure 10. A front slit space 51 is provided between the front wall 13 of the enclosure 10 and the baffle 41. A front slit space 52 is provided between the front wall 13 of the enclosure 10 and the baffle 42. Back chambers 61 and 62 are disposed opposite to the front slit spaces 51 and 52 with respect to the baffles 41 and 42. The back chambers 61 and 62 are sealed enclosure structures that are isolated from the resonance chamber 90 and the front slit spaces 51 and 52. The front slit spaces 51 and 52 are connected to the resonance chamber 90 via communication apertures 71 and 72. The speaker units 33 and 34 (e.g., including a second speaker unit 30*b*) are installed in the baffles (second baffles) 43 and 44 in a second direction Z2 opposite the first direction Z1, e.g., to face a back wall 14 of the enclosure 10. A front slit space 53 is provided between the back wall 14 of the enclosure 10 and the baffle 43. A front slit space 54 is provided between the back wall 14 of the enclosure 10 and the baffle 44. Back chambers 63 and 64 are disposed opposite to the front slit spaces 53 and 54 with respect to the baffles 43 and 44. The back chambers 63 and 64 are isolated from the resonance chamber 90 and the front slit spaces 53 and 54. The front slit spaces 53 and 54 of the speaker units 33 and 34 are connected to the resonance chamber 90 via communication apertures 73 and 74. The resonance chamber 90 is separated from the front slit spaces 51 to 54 and the back chambers 61 to 64 by partitions 15 and 16. The communication apertures 71 to 74 that communicate the front slit spaces 51 to 54 with the resonance chamber 90 are provided in the partitions 15 and 16. The first baffles 41 and 42 and the second baffles 43 and 44 are located to make a step in the first direction Z1. The speaker units 31 to 34 and the resonance chamber 90 are arranged in a direction perpendicular to the first direction Z1. Due to the above structure, the speaker units 31 to 34 may be arranged in a non-coaxial structure.

The thicknesses of the front slit spaces 51 to 54 are determined to be as thin as possible within a range in which an excursion of the diaphragm 31*a* is acceptable and unnecessary resonance is not generated in the front slit spaces 51 to 54. Thus, the thickness of the loudspeaker 1 may be decreased.

The speaker units 31 to 34 may be arranged in a non-coaxial force-moment compensation structure. For example, the speaker units 31 to 34 are spaced apart the same distance from the center of gravity CP of the loudspeaker 1. The speaker units 31 and 32 are located to be symmetrical to the center of gravity CP. The speaker units 33 and 34 are located to be symmetrical to the center of gravity CP. When the speaker units 31 to 34 are driven by the same driving signal, a driving force F generated by the speaker units 31 and 32 in the first direction Z1 and a driving force F generated by the speaker units 33 and 34 in the second direction Z2 are offset by each other and thus the sum of the driving forces F generated by the speaker units 31 to 34 becomes '0'. Also, since the distances from the speaker units 31 to 34 to the center of gravity CP are the same, the sum of moments generated by the driving forces F generated by the speaker units 31 to 34 also becomes '0'. Due to this structure, the non-coaxial force-moment compensation structure may be realized.

The sum of the numbers of the first speaker unit 30*a* and the second speaker unit 30*b* realized in the non-coaxial force-moment compensation structure is '3' or more. When a driving force generated by the first speaker unit 30*a* and a driving force generated by the second speaker unit 30*b* are the same, the sum of the numbers of the first speaker unit 30*a* and the second speaker unit 30*b* is an even number. When the sum of the numbers of the first speaker unit 30*a* and the second speaker unit 30*b* is an odd number, the driving force generated by the first speaker unit 30*a* and the driving force generated by second speaker unit 30*b* may be different. For example, when the sum of the numbers of the first speaker unit 30*a* and the second speaker unit 30*b* is '3', one first speaker unit 30*a* having a driving force of 2F may be arranged at the center of gravity CP of the loudspeaker 1, and two second speaker units 30*b* each having a driving force of F may be arranged to be symmetrical to the first speaker unit 30*a*. The number, driving force, and geometric arrangement of each of the first speaker unit 30*a* and the second speaker unit 30*b* may be appropriately determined to satisfy the non-coaxial force-moment compensation structure. If the non-coaxial force-moment compensation structure is satisfied, the baffles 41 to 44 of the first speaker unit 30*a* and the second speaker unit 30*b* need not be disposed on the same plane. However, as described above, the thickness of the enclosure 10 may be decreased when the first baffles 41 and 42 and the second baffles 43 and 44 are arranged to make a step in the first direction Z1.

When the sum of the numbers of the first speaker unit 30*a* and the second speaker unit 30*b* is an even number, the first speaker unit 30*a* and the second speaker unit 30*b* are arranged to be symmetrical to the center of gravity CP. Thus, the resonance chamber 90 that communicates with the front slit spaces 51 to 54 of the first speaker unit 30*a* and the second speaker unit 30*b* may be easily employed.

The acoustic power of the loudspeaker 1 depends on the volume velocity of an acoustic medium, i.e., air, which is vibrated by the diaphragm 31*a*. In order to increase the acoustic power, the excursion or area of the diaphragm 31*a* may be increased. It is difficult to increase the excursion of the diaphragm 31*a* when there is a restriction to increasing the thickness of the loudspeaker 1, for example, when the loudspeaker 1 is applied to a slim type electronic device such as a flat panel television (TV) or when a slim type stand-alone loudspeaker is to be realized. Driving forces of a plurality of speaker units and moments accompanied by the driving forces may cause the loudspeaker 1 to vibrate.

According to the example embodiment, an acoustic emission area of the loudspeaker 1 is equal to the sum of the areas of the diaphragms 31*a* of the speaker units 31 to 34. Thus a large acoustic emission area may be secured. Because the first speaker unit 30*a* and the second speaker unit 30*b* having different acoustic emission directions are arranged in the non-coaxial structure, a slim type loudspeaker 1 having a thin thickness may be manufactured.

Since the first speaker unit 30*a* and the second speaker unit 30*b* are operated in opposite directions, driving forces of the first speaker unit 30*a* and the second speaker unit 30*b* and moments generated by the driving forces may be partially offset. The sum of the driving forces and the sum of the moments may be less than those in a structure in which the loudspeakers 31 to 34 are operated in the same direction and thus vibration of the loudspeaker 1 may be decreased. Furthermore, the first speaker unit 30*a* and the second speaker unit 30*b* may be arranged in the non-coaxial force-moment compensation structure so that both of the sum of the driving forces and the sum of the moments may be '0'. Thus, the loudspeaker 1 that hardly vibrates and that has high acoustic power may be manufactured.

Sound emitted from the speaker units 31 to 34 may be amplified, for example, by the band-pass amplifier 25 and is then emitted via the acoustic emission aperture 20. The resonance chamber 90 and the duct 91 together form a Helmholtz resonator. The Helmholtz resonator is capable of amplifying sound corresponding to a resonance frequency and blocking sounds corresponding to frequencies higher than the resonance frequency. Thus, the Helmholtz resonator may act as a band-pass filter. If, for example, the volume of the resonance chamber 90 is V, a cross-sectional area of the duct 91 is A, the length of the duct 91 is d, and the velocity of sound in air is C, a resonance frequency $f_0$ of the Helmholtz resonator may be determined by the formula $$f_0 = \frac{C}{2\pi}\sqrt{\frac{A}{dV}}.$$

Thus, the volume of the resonance chamber 90 and the cross-sectional area and length of the duct 91 may be appropriately determined such that sound of a desired frequency is amplified based on the resonance frequency $f_0$ and is then emitted via the acoustic emission aperture 20.

A loudspeaker having a force-moment offset compensation structure includes the first speaker unit 30*a* emitting sound in the first direction Z1 and the second speaker unit 30*b* emitting sound in the second direction Z2. Sound is divided and emitted in two directions when an acoustic emission aperture is formed in front of each of the first and second speaker units 30*a* and 30*b*, for example, when acoustic emission apertures for the first and second speaker units 30*a* and 30*b* are formed in the front wall 13 and the back wall 14 of FIGS. 3 and 4. When such a loudspeaker is applied to a slim type electronic device, for example, when the loudspeaker is applied as a woofer system for a flat panel TV, the front of the loudspeaker is blocked by a display and the back of the loudspeaker is blocked by a back panel. Thus, sound should be emitted via a very narrow acoustic duct according to a bottom, side, or top surface emission manner. In this case, sound may be lost in the acoustic duct and thus high acoustic power is difficult to obtain. Thus, in order to obtain high acoustic power, the size of the loudspeaker should be increased.

Figure 5:
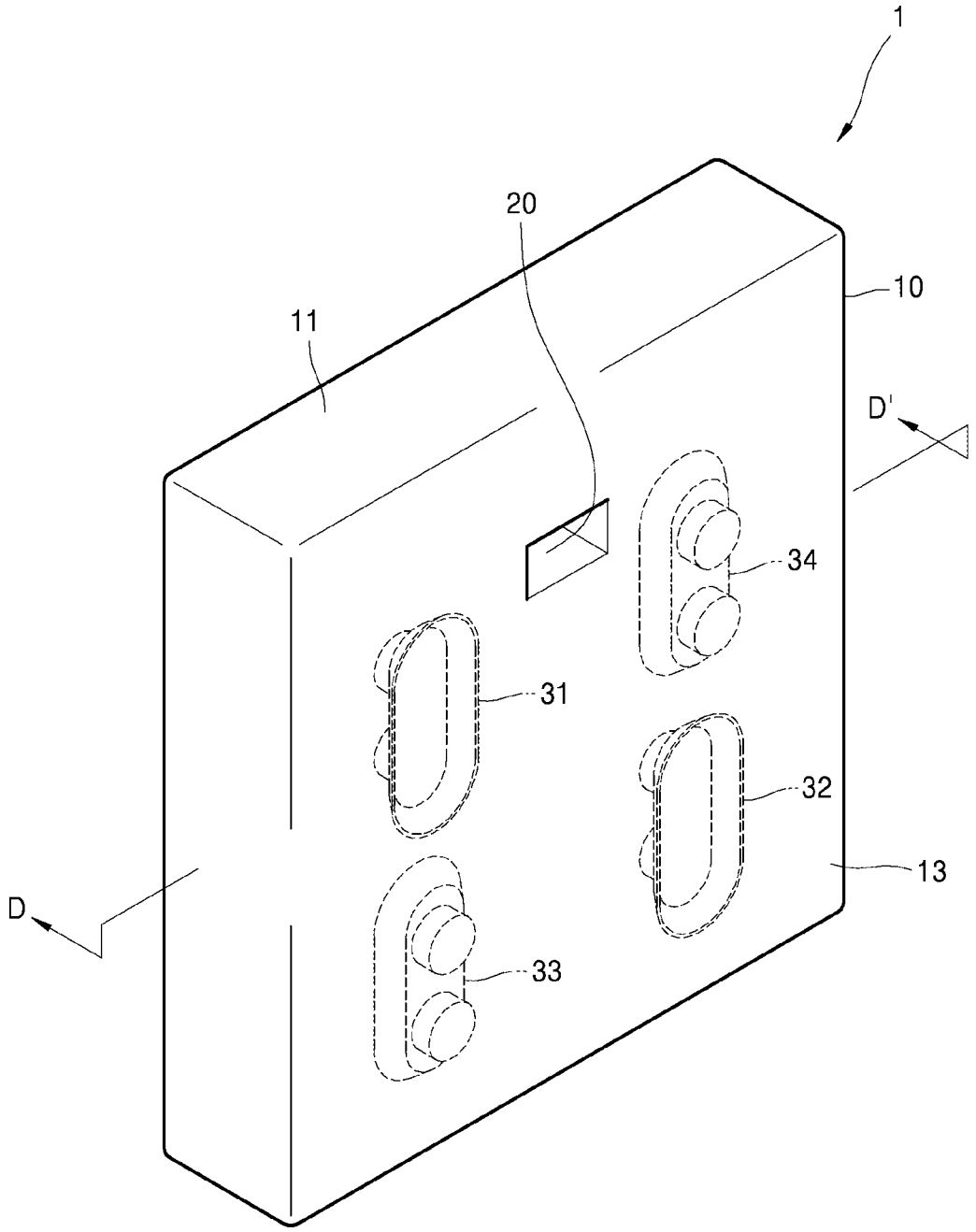
FIG. 5 is a perspective view illustrating an example loudspeaker.
Figure 6:
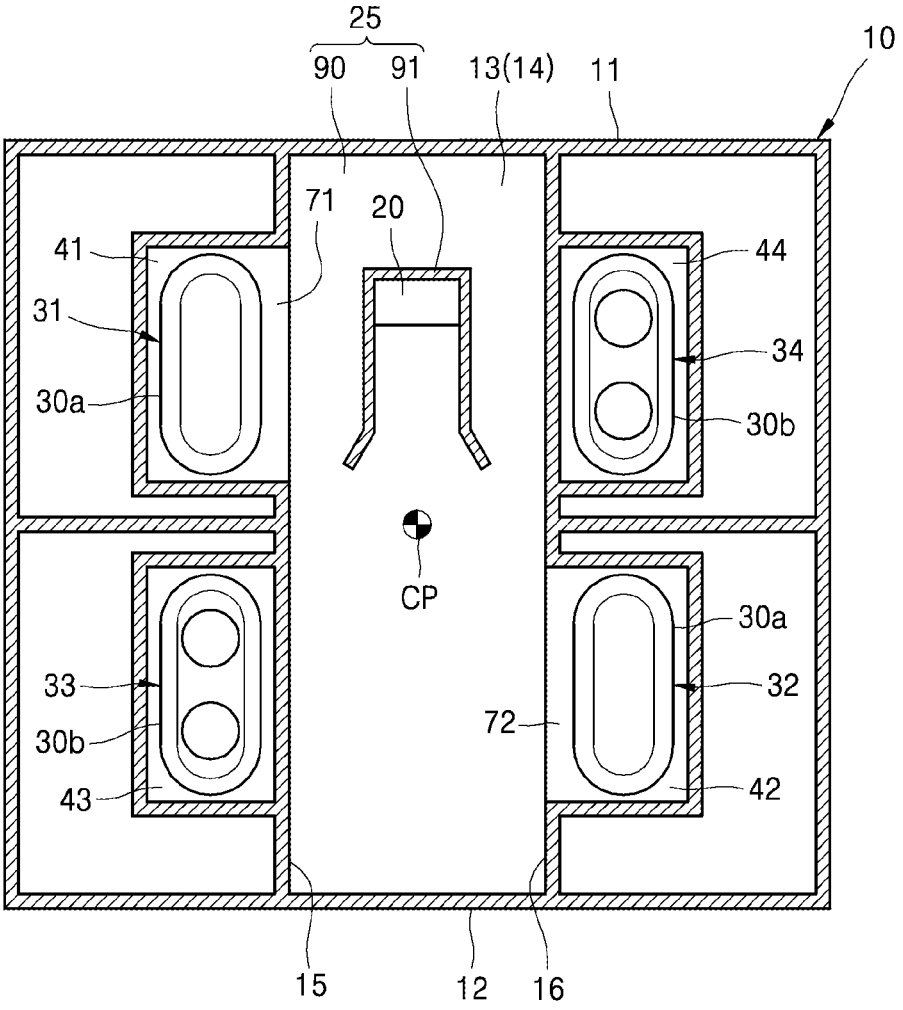
FIG. 6 is a cross-sectional view of FIG. 5, taken along line D-D'.

According to the example embodiment, sound emitted from the first and second speaker units 30*a* and 30*b* is collected in the resonance chamber 90 and then sound at a specific frequency band is amplified through, for example, a Helmholtz resonator action and emitted via the common acoustic emission aperture 20. The position of the acoustic emission aperture 20 is not limited within a range in which the duct 91 may be connected to the resonance chamber 90. For example, although the acoustic emission aperture 20 is formed in the upper wall 11 of the enclosure 10 in the example embodiments of FIGS. 2 to 4, the position of the acoustic emission aperture 20 is not limited thereto. FIG. 5 is a perspective view illustrating an example loudspeaker 1. FIG. 6 is a cross-sectional view of the loudspeaker 1 of FIG. 5, taken along line D-D'. Referring to FIGS. 5 and 6, an acoustic emission aperture 20 is formed in a front wall 13 of an enclosure 10. A duct 91 may connect a resonance chamber 90 and the acoustic emission aperture 20 such that sound of a desired frequency is amplified based on a resonance frequency and emitted via the acoustic emission aperture 20. Although not shown, the acoustic emission aperture 20 may be formed in a back wall 14 or a lower wall 12 of the enclosure 10.

As described above, the loudspeaker 1 according to the example embodiment is capable of collecting sound emitted from first and second speaker units 30*a* and 30*b* and emitting the sound via the acoustic emission aperture 20 which is commonly used. Thus, a sufficient acoustic emission area may be secured, and the loudspeaker 1 having the common acoustic emission aperture 20 may be realized in the non-coaxial structure or the non-coaxial force-moment compensation structure. Furthermore, the degrees of freedom of the position and an acoustic emission direction of the acoustic emission aperture 20 are large and thus the loudspeaker 1 employing the non-coaxial structure or the non-coaxial force-moment compensation structure is very effectively applicable to slim type electronic devices.

Since the resonance chamber 90 and front slit spaces 51 to 54 are arranged in a direction perpendicular to the first direction Z1, sound emitted from speaker units 31 to 34 in the first and second directions Z1 and Z2 propagates along a sound duct formed by the front slit spaces 51 to 54 and is then transferred the resonance chamber 90 via communication apertures 71 to 74. The sound duct may be a factor that decreases acoustic power. In the loudspeaker 1 according to the example embodiment, a Helmholtz resonator is employed to amplify and output sound at a specific frequency band. Thus, a decrease in an output sound level may be compensated for while sound is collected. Also, when an output sound level is fixed, an excursion of a diaphragm 31*a* may be decreased to secure a high operating reliability. For example, when the loudspeaker 1 according to the example embodiment is applied to a woofer system, a band-pass enclosure type woofer system capable of performing bass boosting and having a remarkably reduced volume of a back chamber may be manufactured.

Figure 7:
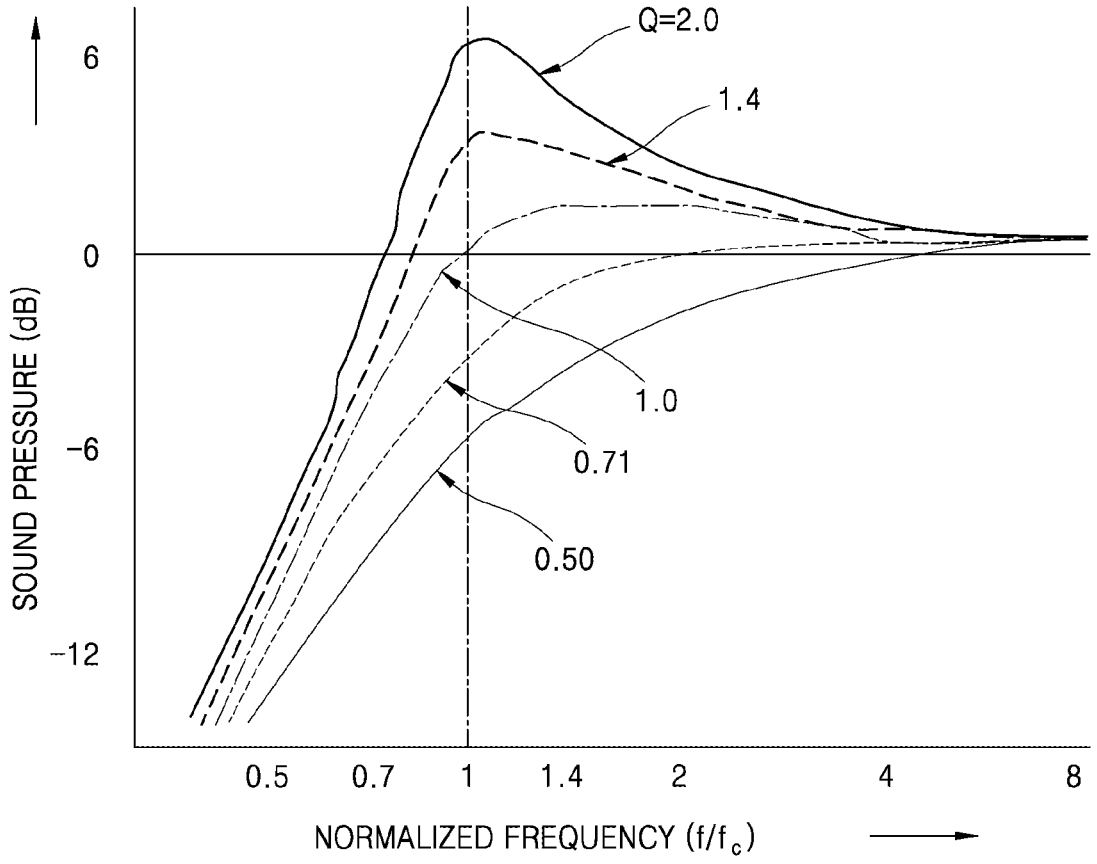
FIG. 7 is a graph illustrating an example frequency response based on a variation in a quality factor.

FIG. 7 is a graph illustrating an example frequency response according to a variation in a quality factor Q. In FIG. 7, a horizontal axis denotes a normalized frequency $f/f_c$ obtained by normalizing a frequency f with a cutoff frequency $f_c$, and a vertical axis denotes a sound pressure in dB. Referring to FIG. 7, as the quality factor Q increases, a sound pressure sharply rises while forming a knee near the cutoff frequency $f_c$. As described above, when the quality factor Q is high, a transient time of a frequency response is long. Thus, the articulation of the whole speaker system is degraded. For example, in the case of a woofer system, a sound pressure sharply rises while forming a knee near a bass roll-off frequency. Such degradation in the articulation of the woofer system may be improved by reducing the quality factor Q. The quality factor Q may be reduced by applying acoustic resistance to a sound duct connected to a resonator.

Figure 8:
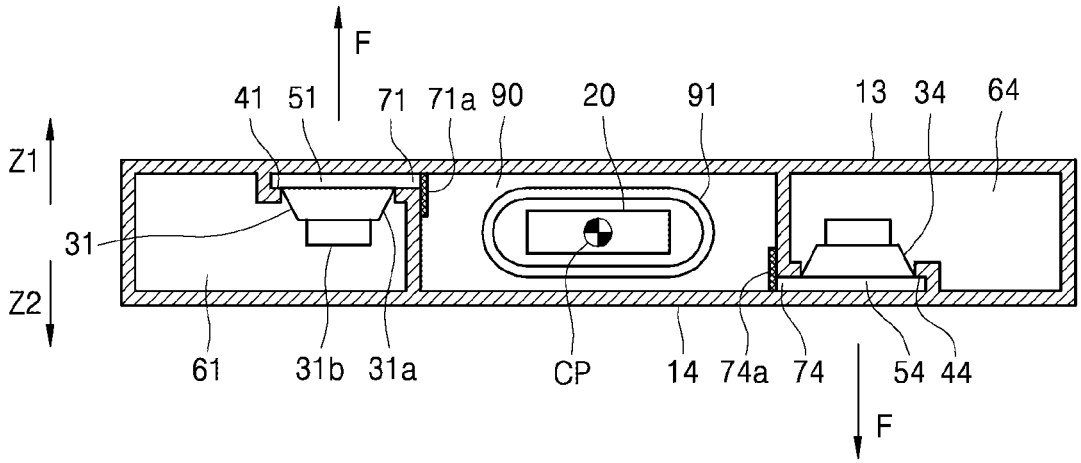
FIGS. 8 and 9 are cross-sectional views illustrating an example loudspeaker.
Figure 9:
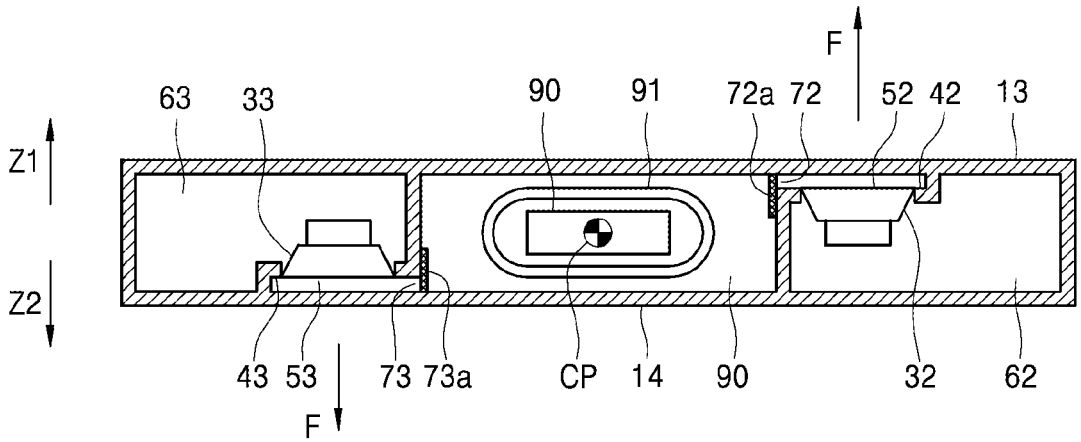

FIGS. 8 and 9 are cross-sectional views illustrating an example loudspeaker 1. FIGS. 8 and 9 correspond generally to FIGS. 3 and 4, respectively. Referring to FIGS. 8 and 9, attenuators 71*a* to 74*a* configured to apply acoustic resistance are located in communication apertures 71 to 74, respectively. For example, the attenuators 71*a* to 74*a* may be porous fabrics, punching plates, etc. The acoustic resistance depends on aperture ratios of the attenuators 71*a* to 74*a*. Thus, a desired quality factor Q may be obtained by employing the attenuators 71*a* to 74*a* each having an appropriate aperture ratio. As described above, when the attenuators 71*a* to 74*a* are employed, the articulation of the loudspeaker 1 may be improved.

Although the back chambers 61 to 64 have a sealed enclosure structure isolated from the outside in the above examples, the structures of the back chambers 61 to 64 are not limited thereto.

Figure 10:
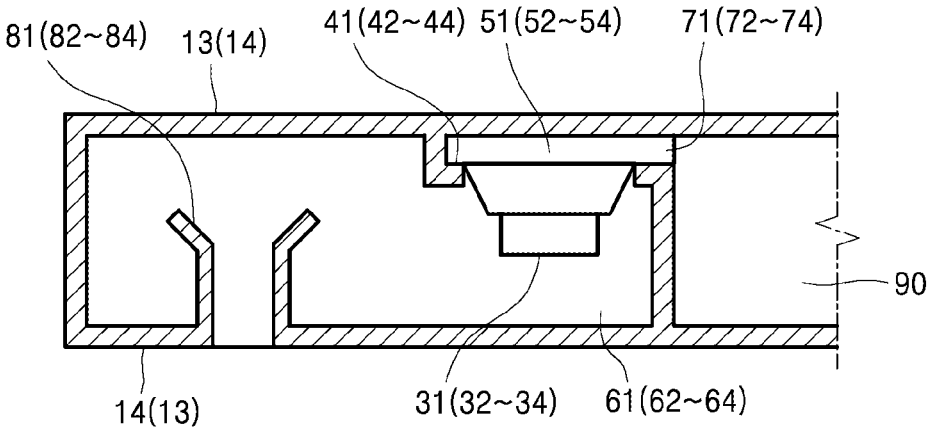
FIG. 10 is a partial cross-sectional view illustrating an example loudspeaker.

FIG. 10 is a partial cross-sectional view illustrating an example loudspeaker 1. FIG. 10 illustrates only a back chamber 61 but back chambers 62 to 64 have the same structure as the back chamber 61. Thus, the reference numerals assigned to the back chambers 62 to 64 and elements thereof are also illustrated in the form of parenthesis in FIG. 10. Referring to FIG. 10, the back chambers 61 to 64 have a vented enclosure structure. Referring to FIG. 10, the back chambers 61 to 64 communicate with the outside of an enclosure 10 via ducts 81 to 84. The back chambers 61 to 64 and the ducts 81 to 84 act together as a Helmholtz resonator. The frequency of sound passing through the ducts 81 to 84 depends on the lengths and cross-sectional areas of the ducts 81 to 84. In the vented enclosure structure, the phase of low-frequency energy formed in the back chambers 61 to 64 by speaker units 31 to 34 may be converted and then the phase-converted low-frequency energy may be emitted to the outside of the enclosure 10. Thus, a low-frequency output of the loudspeaker 1 may be improved and acoustic energy of the back chambers 61 to 64 may be effectively used, thereby improving the efficiency of the loudspeaker 1. Also, a small-sized and slim type loudspeaker 1 capable of obtaining the same output may be realized.

Figure 11:
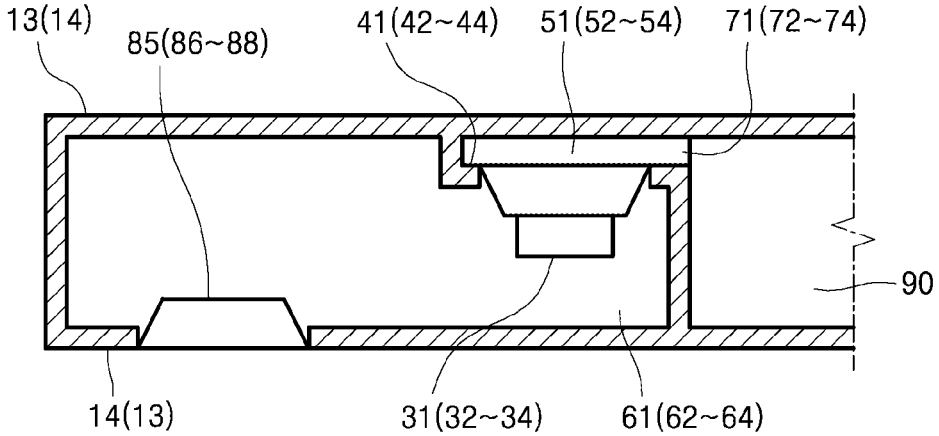
FIG. 11 is a partial cross-sectional view illustrating an example loudspeaker.

FIG. 11 is a partial cross-sectional view illustrating an example loudspeaker 1. FIG. 11 illustrates only a back chamber 61 but back chambers 62 to 64 have the same structure as the back chamber 61. Thus, the reference numerals assigned to the back chambers 62 to 64 and elements thereof are also illustrated in the form of parenthesis in FIG. 11. Referring to FIG. 11, the back chambers 61 to 64 have a passive radiator type enclosure structure. Referring to FIG. 11, passive radiators 85 to 88 facing the outside of an enclosure 10 are installed in the back chambers 61 to 64, respectively. The passive radiators 85 to 88 each include a diaphragm but do not include a motor. Thus, the passive radiators 85 to 88 are operated based on a change in pressure applied to the back chambers 61 to 64 when speaker units 31 to 34 are operated. Frequency tuning may be easily performed on the passive radiators 85 to 88 by controlling the mass of the diaphragm and the hardness of a suspension. Due to the above structure, acoustic energy of the back chambers 61 to 64 may be effectively used to improve the efficiency of the loudspeaker 1. Also, a small-sized and slim type loudspeaker 1 capable of obtaining the same output may be realized.

Figure 12:
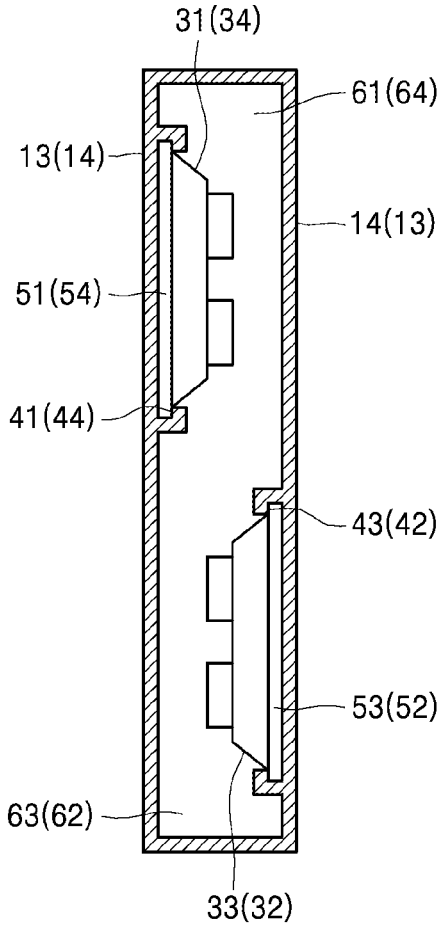
FIG. 12 is a cross-sectional view illustrating an example loudspeaker.

Although the back chambers 61 to 64 are independent and isolated with each other in the example embodiments of FIGS. 1 to 4, at least one among the back chambers 61 to 64 may communicate with the other back chambers. FIG. 12 is a cross-sectional view illustrating an example loudspeaker 1. FIG. 12 illustrates a modified example of the loudspeaker 1 illustrated in FIGS. 1 to 4. FIG. 12 is a cross-sectional view of FIG. 2, taken along lines E-E' and F-F'. In FIG. 12, reference numerals enclosed in a parenthesis belong to a cross-sectional view taken along line F-F', and the other reference numerals that are not enclosed in a parenthesis belong to a cross-sectional view taken along line E-E'. Referring to FIGS. 2 and 12, the back chambers 61 and 63 of the speaker units (e.g., first speaker group) 31 and 33 located to one side of the resonance chamber 90 and the back chambers 62 and 64 of the speaker units (e.g., second speaker group) 32 and 34 located on another side of the resonance chamber 90 communicate with one another. For example, the first speaker unit 31 and the second speaker unit 33 make a pair and the back chambers 61 and 63 thereof communicate with each other. The first speaker unit 32 and the second speaker unit 34 make a pair and the back chambers 62 and 64 thereof communicate with each other.

Due to the above structure, effective capacities of these back chambers may be increased. Air in the back chambers 61 to 64 acts, for example, as a spring when the speaker units 31 to 34 are operated. A spring constant of a vibration system including these speaker units is equal to the sum of a spring constant of a suspension of the diaphragm and a spring constant provided by the air in the back chambers 61 to 64. A resonant frequency of the vibration system is proportional to the square of the spring constant. When the volumes of the back chambers 61 to 64 increase, the spring constant provided by the air in the back chambers 61 to 64 decreases, thereby lowering the spring constant of the vibration system. Accordingly, the resonant frequency of the vibration gauge decreases and thus low-frequency characteristics of the loudspeaker 1 may be improved.

Although the first and second speaker units 30*a* and 30*b* are configured to communicate with one resonance chamber 90 in the above examples, the loudspeaker 1 may include two or more resonance chambers.

Figure 13:
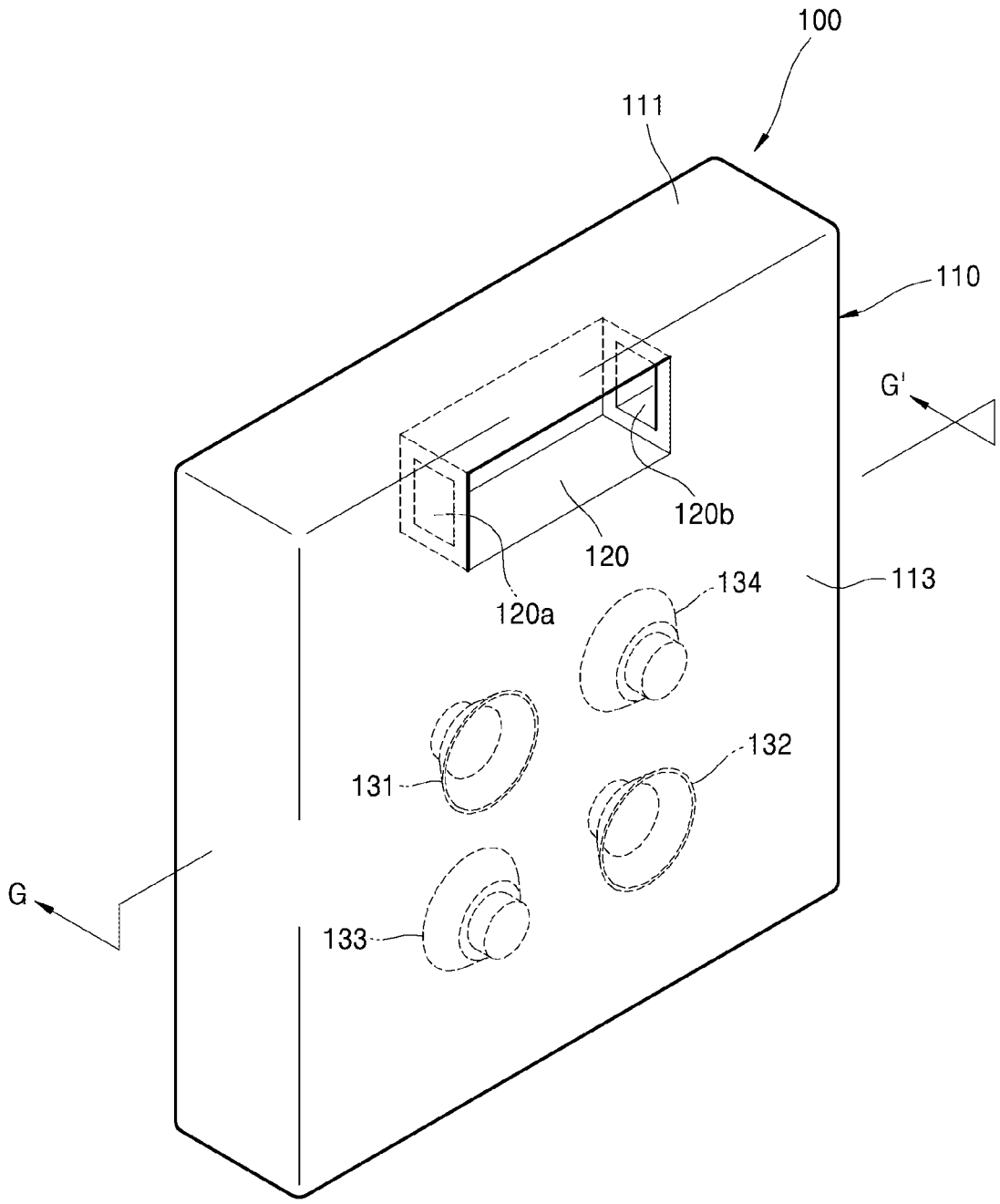
FIG. 13 is a perspective view illustrating an example loudspeaker.
Figure 14:
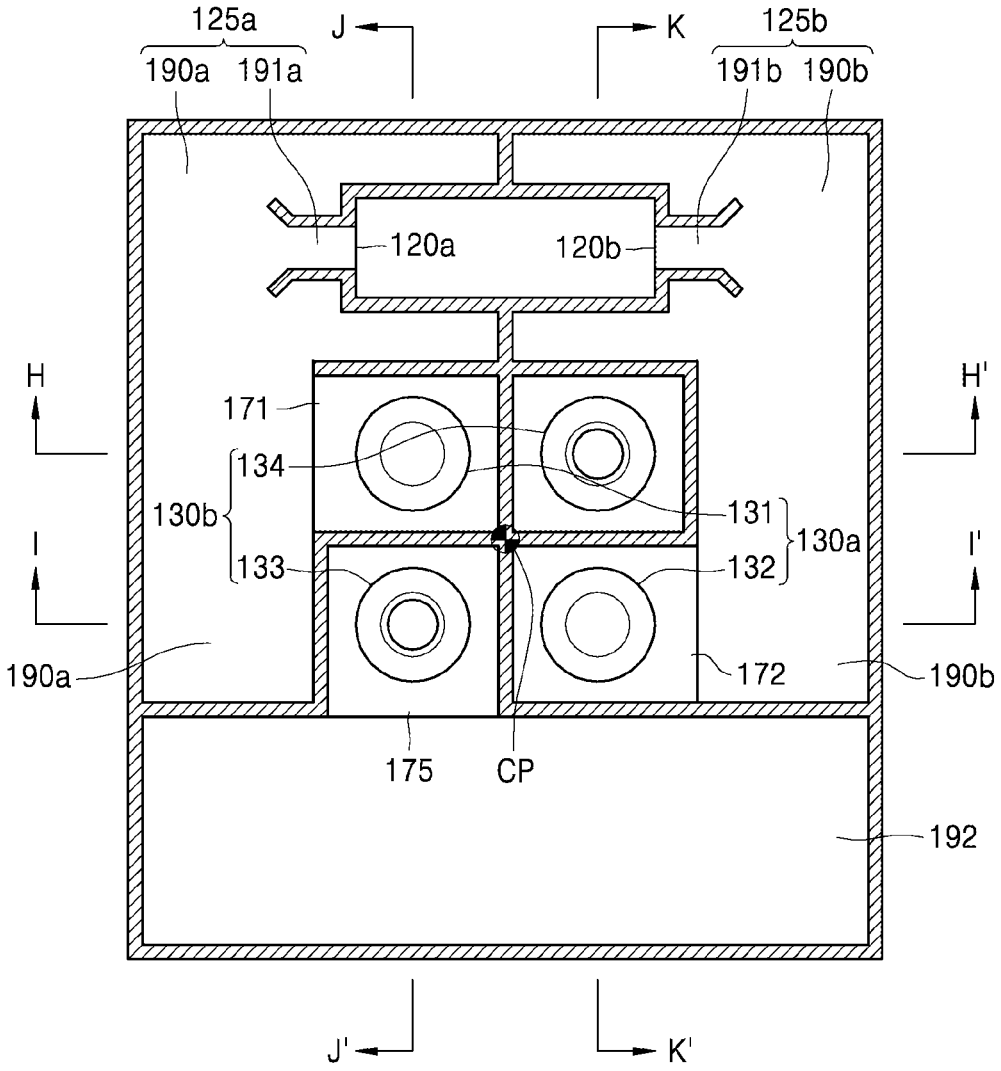
FIG. 14 is a cross-sectional view of FIG. 13, taken along line G-G'.
Figure 15:
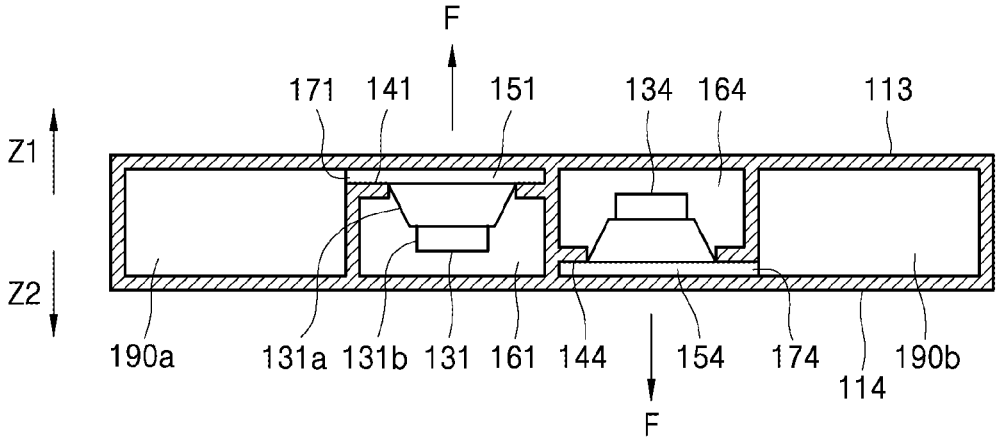
FIG. 15 is a cross-sectional view of FIG. 14, taken along line H-H'.
Figure 16:
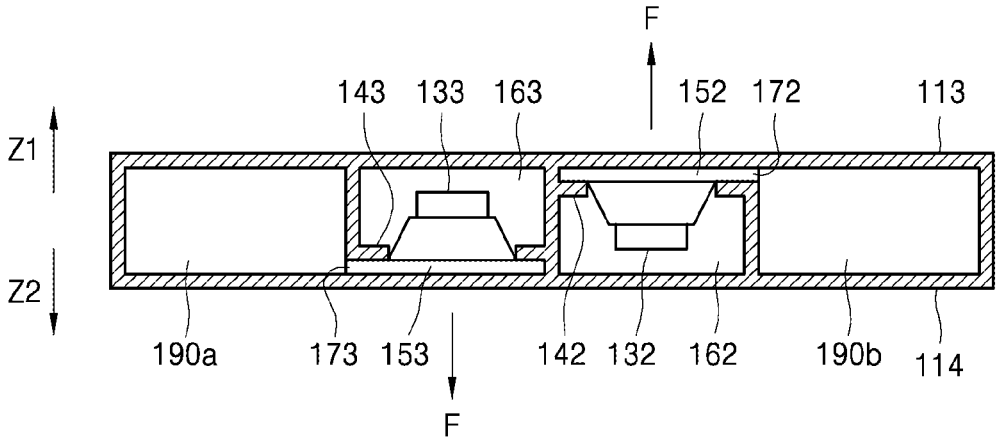
FIG. 16 is a cross-sectional view of FIG. 14, taken along line I-I'.

FIG. 13 is a perspective view illustrating an example loudspeaker 100. FIG. 14 is a cross-sectional view of FIG. 13, taken along line G-G'. FIG. 15 is a cross-sectional view of FIG. 14, taken along line H-H'. FIG. 16 is a cross-sectional view of FIG. 14, taken along line I-I'.

Referring to FIGS. 13 to 16, the loudspeaker 100 includes an enclosure 110, four speaker units 131 to 134 located in the enclosure 110, and first and second resonance chambers 190*a* and 190*b*. In the enclosure 110, a through-unit (e.g., aperture) 120 passing through at least one of a front wall 113 and a back wall 114 is provided. In the through-unit 120, first and second acoustic emission apertures 120*a* and 120*b* are provided. The first and second acoustic emission apertures 120*a* and 120*b* communicate with the first and second resonance chambers 190*a* and 190*b* via first and second ducts 191*a* and 191*b*, respectively. The through-unit 120 acts as an integrated acoustic emission aperture via which sound is emitted from the speaker units 131 to 134. Each of the speaker units 131 to 134 includes a diaphragm 131*a* and a motor 131*b* for driving the diaphragm 131*a*. The motor 131*b* may employ a moving coil manner or a moving magnet manner. In the example embodiment, the diaphragm 131*a* may have, for example, a round shape.

In the enclosure 110, baffles 141 to 144 in which the speaker units 131 to 134 are respectively disposed are provided. The speaker units 131 and 132 (a first speaker unit 130*a*) are disposed in the baffles 141 and 142 in a first direction Z1, e.g., to face the front wall 113 of the enclosure 110. Back chambers 161 and 162 of the speaker units 131 and 132 are isolated from the first and second resonance chambers 190*a* and 190*b* and front slit spaces 151 and 152. The speaker units 133 and 134 (a second speaker unit 130*b*) are disposed in the baffles 143 and 144 in a second direction Z2 opposite the first direction Z1, e.g., to face the back wall 114 of the enclosure 110. The back chambers 163 and 164 of the speaker units 133 and 134 are isolated from the first and second resonance chambers 190*a* and 190*b* and front slit spaces 153 and 154. The speaker units 131 to 134 and the first and second resonance chambers 190*a* and 190*b* are arranged in a direction perpendicular to the first direction Z1.

As described above, at least one among the speaker units 131 to 134 is arranged in a direction opposite the direction in which the other speaker units are arranged. Thus, the sum of driving forces of the speaker units 131 to 134 and the sum of moments generated by the driving forces may be reduced.

The speaker units 131 to 134 may be disposed in the enclosure 110 in the non-coaxial force-moment compensation structure. The speaker units 131 to 134 are spaced apart the same distance from a center of gravity CP of the loudspeaker 100. The speaker units 131 and 132 are located to be symmetrical to the center of gravity CP. The speaker units 133 and 134 are located to be symmetrical to the center of gravity CP. Thus, when the speaker units 131 to 134 are driven by the same driving signal, driving forces F generated by the speaker units 131 and 132 in the first direction Z1 and driving forces F generated by the speaker units 133 and 134 in the second direction Z2 are offset by each other and thus the sum of the driving forces F generated by the speaker units 131 to 134 becomes '0', Also, since the distances from the speaker units 131 to 134 to the center of gravity CP are the same, the sum of the moments generated by the driving forces F of the speaker units 131 to 134 also becomes '0'. Due to the above structure, the non-coaxial force-moment compensation structure may be realized.

The front slit spaces 151 and 153 of the speaker units (first speaker group) 131 and 133 are connected to the first resonance chamber 190*a* via first communication apertures 171 and 173, respectively. The front slit spaces 152 and 154 of the speaker units (second speaker group) 132 and 134 are connected to the second resonance chamber 190*b* via second communication apertures 172 and 174, respectively.

The first and second resonance chambers 190*a* and 190*b* form Helmholtz resonators acting as band-pass amplifiers 125*a* and 125*b*, together with first and second ducts 191*a* and 191*b*. By appropriately determining the volumes of the first and second resonance chambers 190*a* and 190*b* and the cross-sectional areas and lengths of the first and second ducts 191*a* and 191*b*, sound at a desired frequency band may be amplified based on a resonance frequency and emitted via the first and second acoustic emission apertures 120*a* and 120*b*.

Figure 17:
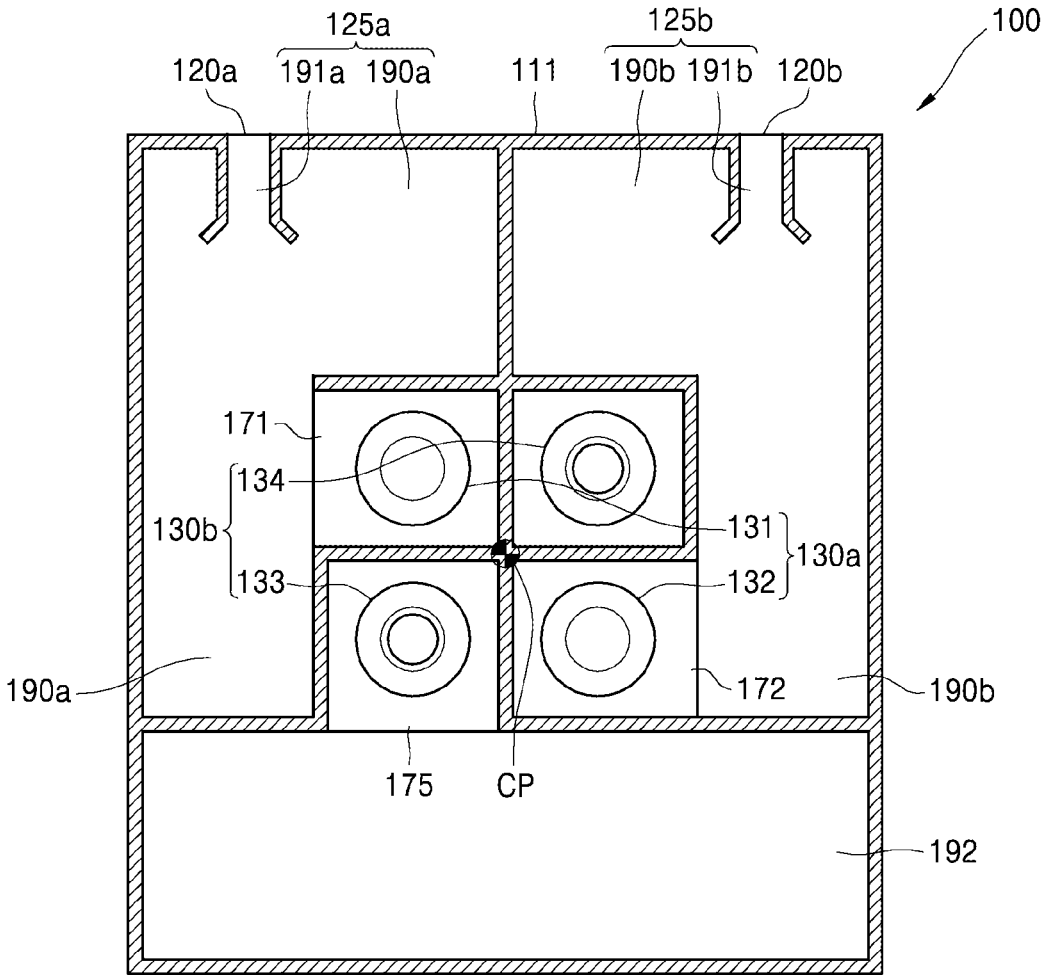
FIG. 17 is a cross-sectional view illustrating an example loudspeaker.
Figure 18:
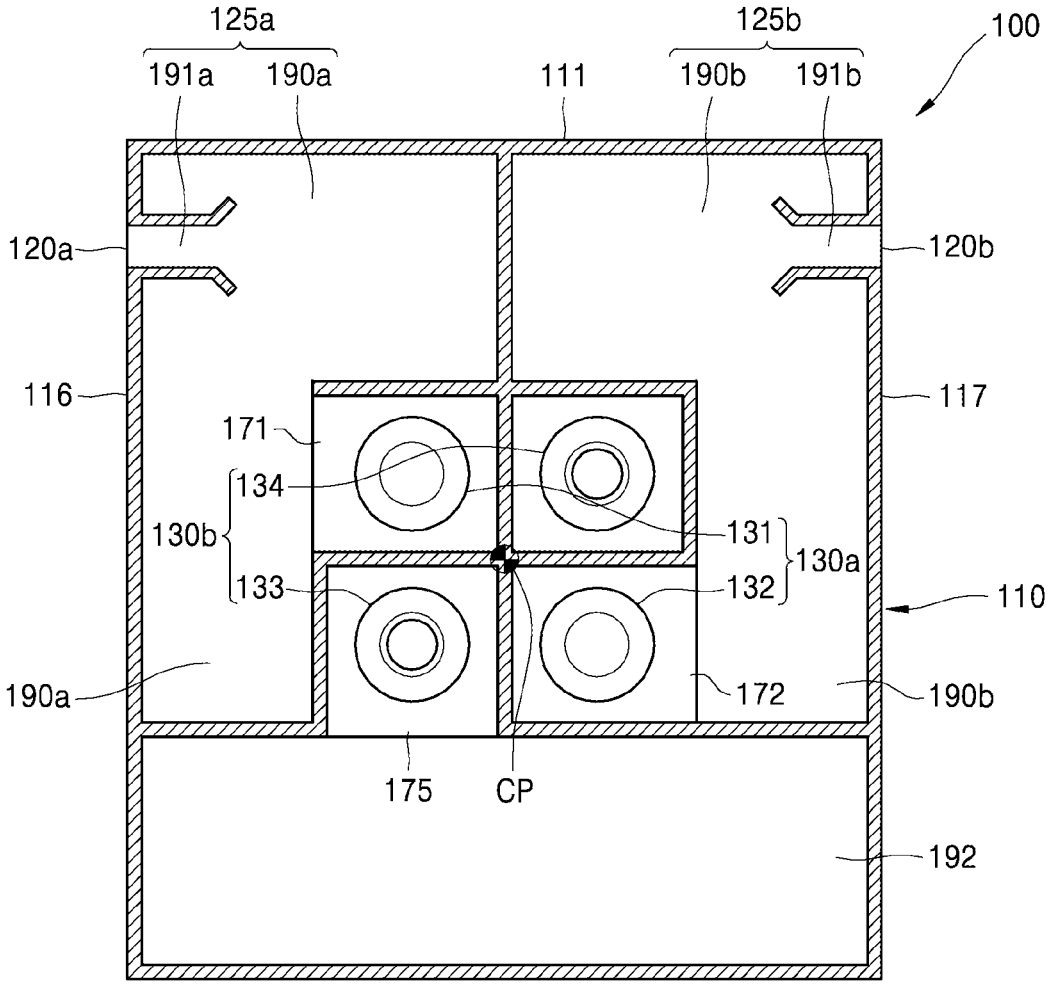
FIG. 18 is a cross-sectional view illustrating an example loudspeaker.

The positions of the first and second acoustic emission apertures 120*a* and 120*b* are not limited within a range in which the first and second ducts 191*a* and 191*b* may be connected to the first and second resonance chambers 190*a* and 190*b*. For example, although the first and second acoustic emission apertures 120*a* and 120*b* are formed in the through-unit 120 passing through the front wall 113 and the back wall 114 of the enclosure 110 in the example embodiments of FIGS. 13 to 16, the positions of the first and second acoustic emission apertures 120*a* and 120*b* are not limited thereto. For example, FIGS. 17 and 18 are cross-sectional views illustrating another example loudspeaker 100. The loudspeakers 100 illustrated in FIGS. 17 and 18 are substantially the same as the loudspeaker 100 illustrated in FIG. 14, except for the positions of first and second acoustic emission apertures 120*a* and 120*b*. Referring to FIG. 17, the first and second acoustic emission apertures 120*a* and 120*b* are formed in an upper wall 111 of an enclosure 110. First and second ducts 191*a* and 191*b* extend to the upper wall 111 and respectively connect first and second resonance chambers 190*a* and 190*b* to the first and second acoustic emission apertures 120*a* and 120*b*. Referring to FIG. 18, the first and second acoustic emission apertures 120*a* and 120*b* are respectively formed in sidewalls 116 and 117 of an enclosure 110. The first and second ducts 191*a* and 191*b* extend to the sidewalls 116 and 117 and connect first and second resonance chambers 190*a* and 190*b* to the first and second acoustic emission apertures 120*a* and 120*b*, respectively.

As described above, in the loudspeaker 100 according to the example embodiment, sound emitted from the speaker units 131 and 133 and sound emitted from the speaker units 132 and 134 are respectively collected in the first and second resonance chambers 190*a* and 190*b* and sound at a specific frequency band is then amplified through the Helmholtz resonance action and emitted via the first and second acoustic emission apertures 120*a* and 120*b*. Thus, the loudspeaker 100 may be realized in the non-coaxial structure or the non-coaxial force-moment compensation structure having a high degree of freedom of an acoustic radiation direction. The loudspeaker 100 employing the non-coaxial structure or the non-coaxial force-moment compensation structure is effectively applicable to slim type electronic devices.

Figure 19:
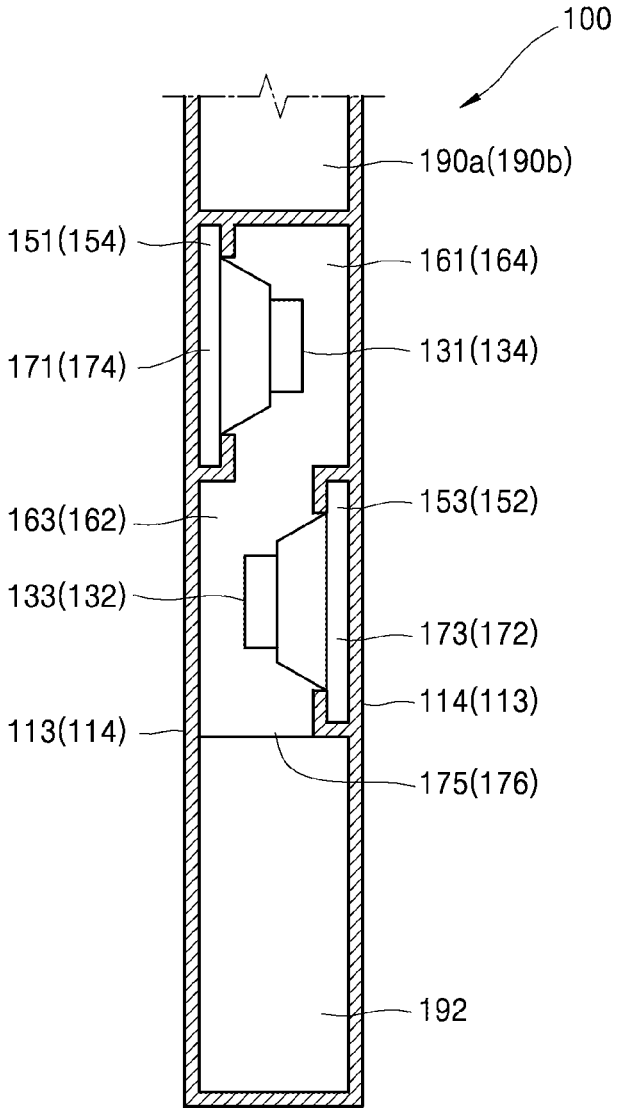
FIG. 19 is a cross-sectional view illustrating an example loudspeaker.

Although the back chambers 161 to 164 are independent and isolated from each other in the example embodiments of FIGS. 13 to 18, at least one among the back chambers 161 to 164 may communicate with the other chambers. FIG. 19 is a cross-sectional view illustrating an example loudspeaker 100 *t*. FIG. 19 is a modified example of the loudspeakers 100 illustrated in FIGS. 13 to 18. FIG. 19 illustrates a cross-sectional view of FIG. 14, taken along lines J-J' and K-K'. In FIG. 19, reference numerals enclosed in a parenthesis belong to a cross-sectional view taken along line K-K', and the other reference numerals that are not enclosed in a parenthesis belong to a cross-sectional view taken along line J-J'. Referring to FIGS. 14 and 19, back chambers 161 and 163 of speaker units (a first speaker group) 131 and 133 adjacent to a first resonance chamber 190*a* communicate with each other, and back chambers 162 and 164 of speaker units (a second speaker group) 132 and 134 adjacent to a second resonance chamber 190*b* communicate with each other. For example, the first speaker unit 131 and the second speaker unit 133 make a pair and the back chambers 161 and 163 thereof communicate with each other. The first speaker units 132 and the second speaker unit 134 make a pair and the back chambers 162 and 164 communicate with each other. Otherwise, the back chambers 161 to 164 may communicate with one another. Due to the above structure, effective capacities of the back chambers 161 to 164 may be increased and low-frequency characteristics of the loudspeaker 100 may be improved.

In the enclosure 110, an additional chamber 192 may be further provided. The additional chamber 192 may be arranged to balance the weight of the enclosure 110 with respect to the speaker units 131 to 134. The additional chamber 192 may be isolated from the first and second resonance chambers 190*a* and 190*b* and front slit spaces 151 to 154. As illustrated in FIG. 19, the back chambers 163 and 162 may be connected to the additional chamber 192 via communication apertures 175 and 176. Due to the above structure, all of the back chambers 161 to 164 may communicate with the additional chamber 192, thereby greatly increasing effective capacities of the back chambers 161 to 164.

The attenuators 71*a* to 74*a* described above with reference to FIGS. 8 and 9 are also applicable to the communication apertures 171 to 174 of the loudspeakers 100 illustrated in FIGS. 13 to 19. Due to the above structure, the attenuators 71*a* to 74*a* having appropriate aperture ratios may be disposed in the communication apertures 171 to 174 to achieve a desired quality factor Q and improve the articulation of the loudspeaker 100.

The vented enclosure structure and the passive radiator type enclosure structure described above with reference to FIGS. 10 and 11 are also applicable to the back chambers 161 to 164 of the loudspeakers 100 illustrated in FIGS. 13 to 19. Due to the above structure, acoustic energy of the back chambers 161 to 164 may be effectively used to improve the efficiency of the loudspeaker 100. Also, a small-sized and slim type loudspeaker 100 capable of obtaining the same output may be manufactured.

Figure 20:
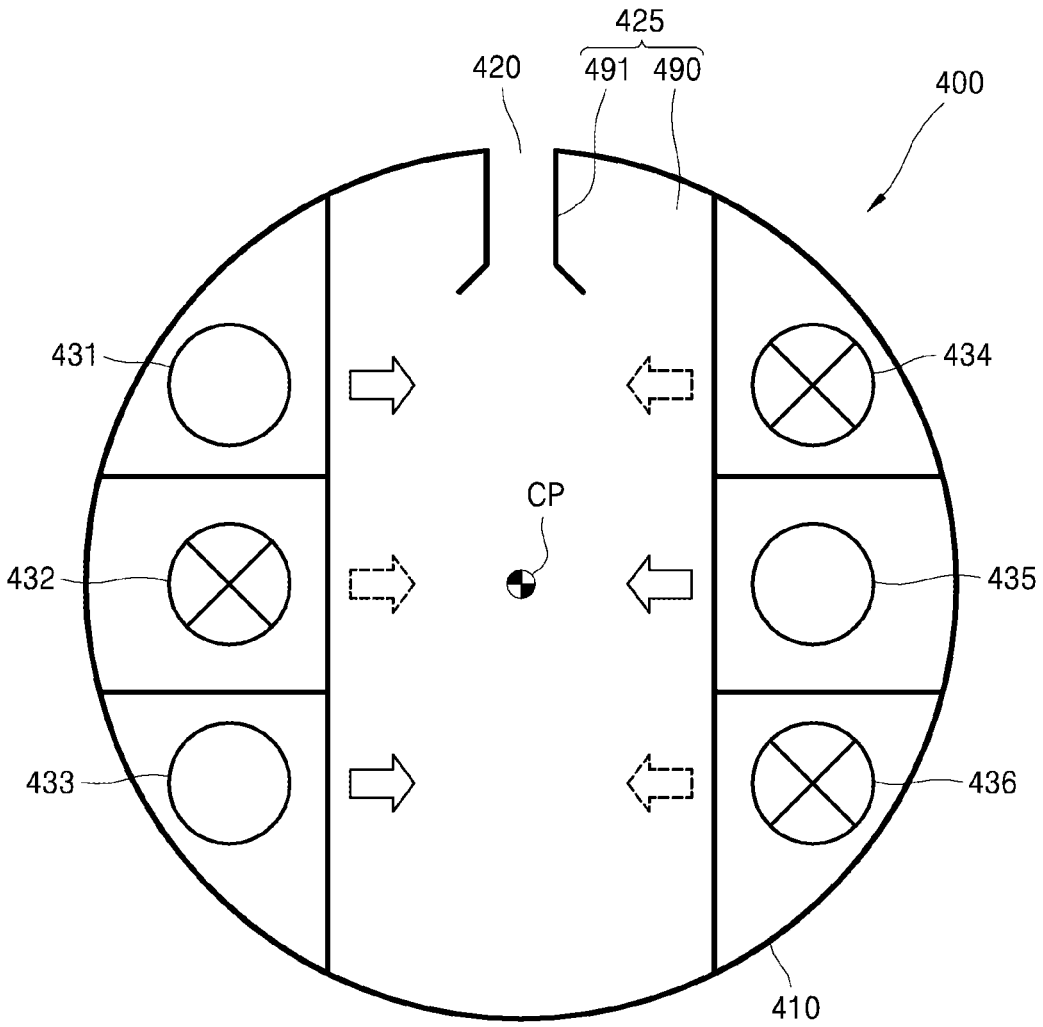
FIG. 20 is a schematic configuration diagram illustrating an example loudspeaker.

Although the loudspeakers 1 and 100 in which four speaker units are arranged in the non-coaxial force-moment compensation structure are described in the above examples, the number of speaker units is not limited to four. FIG. 20 is a schematic configuration diagram illustrating an example loudspeaker 400 including, for example, six speaker units 431 to 436. Referring to FIG. 20, an enclosure 410 may, for example, be a disc type. Speaker units 431, 433, and 435 are first speaker units emitting sound in a first direction. Speaker units 432, 434, and 436 are second speaker units emitting sound in a second direction. The speaker units 431 and 436 make a pair and are arranged to be symmetrical to a center of gravity CP. The speaker units 432 and 435 make a pair and are arranged to be symmetrical to the center of gravity CP. The speaker units 433 and 434 make a pair and are arranged to be symmetrical to the center of gravity CP. Due to the above structure, a non-coaxial force-moment compensation structure in which both of the sum of driving forces and the sum of moments are '0' is realized. Front slit spaces of the six speaker units 431 to 436 are connected to a resonance chamber 490 via a communication aperture (not shown). An acoustic emission aperture 420 is connected to the resonance chamber 490 via a duct 491. The duct 491 and the resonance chamber 490 form a band-pass amplifier 425 together. Due to the above structure, the loudspeaker 400 having a slim type non-coaxial force-moment compensation structure may be realized, in which sound emitted from the speaker units 431 to 436 is collected in the resonance chamber 490 and sound at a specific frequency band is amplified through the Helmholtz resonance action and emitted via the acoustic emission aperture 420.

The vented enclosure structure and the passive radiator type enclosure structure described above with reference to FIGS. 10 and 11 are also applicable to the back chambers of the loudspeaker 400 of FIG. 20. Due to the above structure, acoustic energy of the back chambers may be effectively used to improve the efficiency of the loudspeaker 400. Also, a small-sized and slim type loudspeaker 400 capable of obtaining the same output may be realized. To adjust the articulation of the loudspeaker 400, an attenuator configured to apply acoustic resistance may be disposed in the communication aperture connecting the resonance chamber 490 and the speaker units 431 to 436. Also, the back chambers of the speaker unit 431 to 433 may communicate with one another, and the back chambers of the speaker unit 434 to 436 may communicate with one another.

Figure 21:
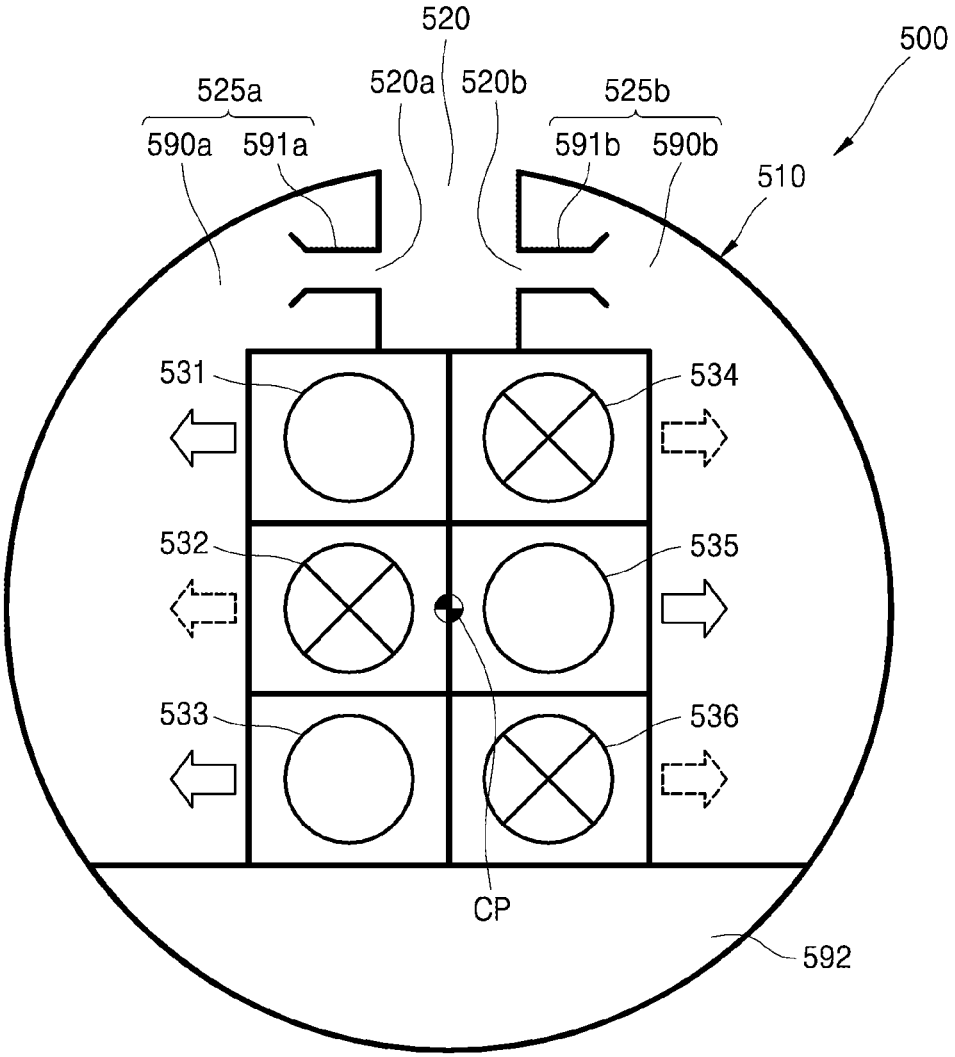
FIG. 21 is a schematic configuration diagram illustrating an example loudspeaker.

FIG. 21 is a schematic configuration diagram illustrating an example loudspeaker 500 including six speaker units 531 to 536. Referring to FIG. 21, an enclosure 510 may, for example, be a disc type. Speaker units 531, 533, and 535 are first speaker units emitting sound in a first direction. Speaker units 532, 534, and 536 are second speaker units emitting sound in a second direction. The speaker units 531 and 536 make a pair and are arranged to be symmetrical to a center of gravity CP. The speaker units 532 and 535 make a pair and are arranged to be symmetrical to the center of gravity CP. The speaker units 533 and 534 make a pair and are arranged to be symmetrical to the center of gravity CP. Due to the above structure, a non-coaxial force-moment compensation structure in which both of the sum of driving forces and the sum of moments are '0' is realized.

The loudspeaker 500 includes first and second resonance chambers 590*a* and 590*b*. In the enclosure 510, first and second acoustic emission apertures 520*a* and 520*b* communicating with an integrated acoustic emission aperture 520 are provided. First and second ducts 591*a* and 591*b* connect the first and second resonance chambers 590*a* and 590*b* to the first and second acoustic emission apertures 520*a* and 520*b*, respectively. The first duct 591*a* and the first resonance chamber 590*a* form a band-pass amplifier 525*a* together. The second duct 591*b* and the second resonance chamber 590*b* together form a band-pass amplifier 525*b*.

Front slit spaces of the speaker units 531 to 533 are connected to the first resonance chamber 590*a* via a communication aperture (not shown). Front slit spaces of the speaker units 534 to 536 are connected to the second resonance chamber 590*b* via a communication aperture (not shown). Due to the above structure, the loudspeaker 500 having a slim type non-coaxial force-moment compensation structure may be realized, in which sound emitted from the speaker units 531 to 533 is collected in the first resonance chamber 590*a* and sound at a specific frequency band is amplified through the Helmholtz resonance action and emitted via the first acoustic emission aperture 520*a*, and sound emitted from the speaker units 534 to 536 is collected in the second resonance chamber 590*b* and sound at a specific frequency band is amplified through the Helmholtz resonance action and emitted via the second acoustic emission aperture 520*b*.

The vented enclosure structure and the passive radiator type enclosure structure described above with reference to FIGS. 10 and 11 are also applicable to back chambers of the loudspeaker 500 of FIG. 21. Due to the above structure, acoustic energy of the back chambers may be effectively used to improve the efficiency of the loudspeaker 500. Also, a small-sized and slim type loudspeaker 500 capable of obtaining the same output may be realized. In order to control the articulation of the loudspeaker 500, an attenuator configured to apply acoustic resistance may be located in each of the communication aperture connecting the resonance chamber 590*a* and the front slit spaces of the speaker units 531 to 533 and the communication aperture connecting the resonance chamber 590*b* and the front slit spaces of the speaker units 534 to 536. The back chambers of the speaker units 531 to 533 may communicate with one another. The back chambers of the speaker units 534 to 536 may communicate with one another. Otherwise, the back chambers of the speaker units 531 to 536 may communicate with an additional chamber 592.

The number of the resonance chambers is not limited to one or two. In the enclosure 510, three or more resonance chambers communicating with the front slit spaces of two or more speaker units may, for example, be provided.

Figure 22:
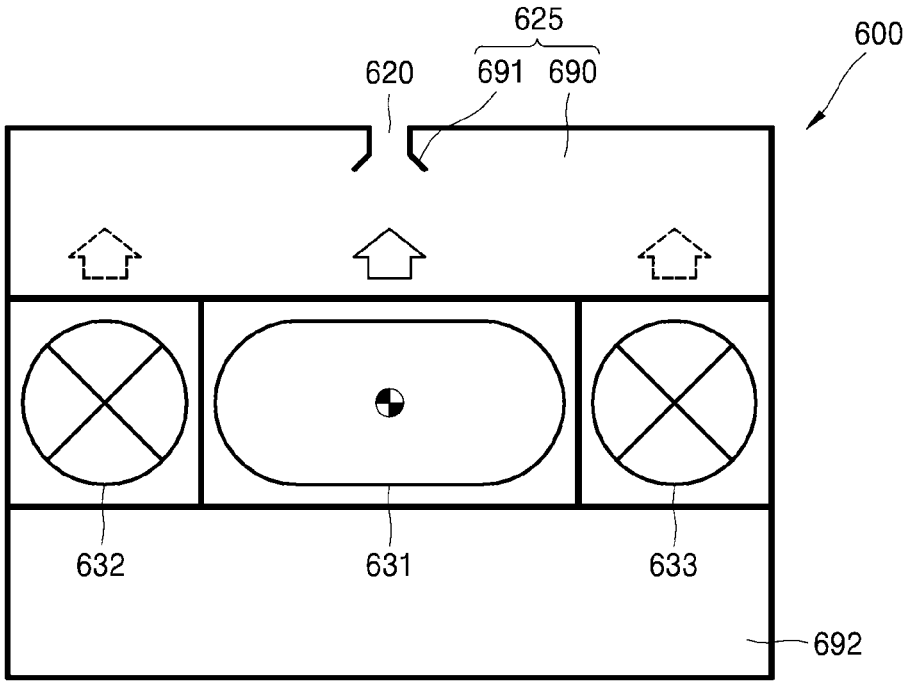
FIG. 22 is a schematic configuration diagram illustrating an example loudspeaker with three speaker units.

The non-coaxial force-moment compensation structure may be realized with an odd number of speaker units. FIG. 22 is a schematic configuration diagram illustrating an example loudspeaker 600 with three speaker units 631 to 633. Referring to FIG. 22, the speaker unit 631 is a first speaker unit emitting sound in the first direction Z1, and the speaker units 632 and 633 are second speaker units emitting sound in the second direction Z2. The speaker unit 631 is located at a center of gravity CP of the loudspeaker 600. The speaker units 632 and 633 are arranged to be symmetrical to the center of gravity CP. The speaker unit 631 has a driving force of 2F. The speaker units 632 and 633 each have a driving force of F. Due to the above structure, a non-coaxial force-moment compensation structure in which both of the sum of the driving forces and the sum of moments are '0' may be realized. Front slit spaces of the speaker units 631 to 633 are connected to a resonance chamber 690 via a communication aperture (not shown). An acoustic emission aperture 620 is connected to the resonance chamber 690 via a duct 691. The duct 691 and the resonance chamber 690 together form a band-pass amplifier 625.

Due to the above structure, a slim type non-coaxial force-moment compensation structure loudspeaker 600 may be realized, in which sound emitted from the speaker units 631 to 633 is collected in the resonance chamber 690 and sound at a specific frequency band is amplified through the Helmholtz resonance action and emitted via the acoustic emission aperture 620. In addition, an odd number of speaker units, e.g., five, seven, or more speaker units, may be arranged in the force-moment compensation structure.

The vented enclosure structure and the passive radiator type enclosure structure described above with reference to FIGS. 10 and 11 are also applicable to the back chambers of the loudspeaker 600 of FIG. 22. In order to control the articulation of the loudspeaker 600, an attenuator configured to apply acoustic resistance may be disposed in the communication aperture connecting the resonance chamber 690 and the front slit spaces of the speaker units 631 to 633. The back chambers of the speaker units 631 to 633 may communicate with one another. The back chambers of the speaker units 631 to 633 may communicate with an additional chamber 692.

Although as a band-pass amplifier to prevent a decrease in a sound output, a Helmholtz resonator in which an acoustic emission aperture is connected to a resonance chamber via a duct is disclosed in the above examples, a structure preventing a decrease in a sound output is not limited thereto.

Figure 23:
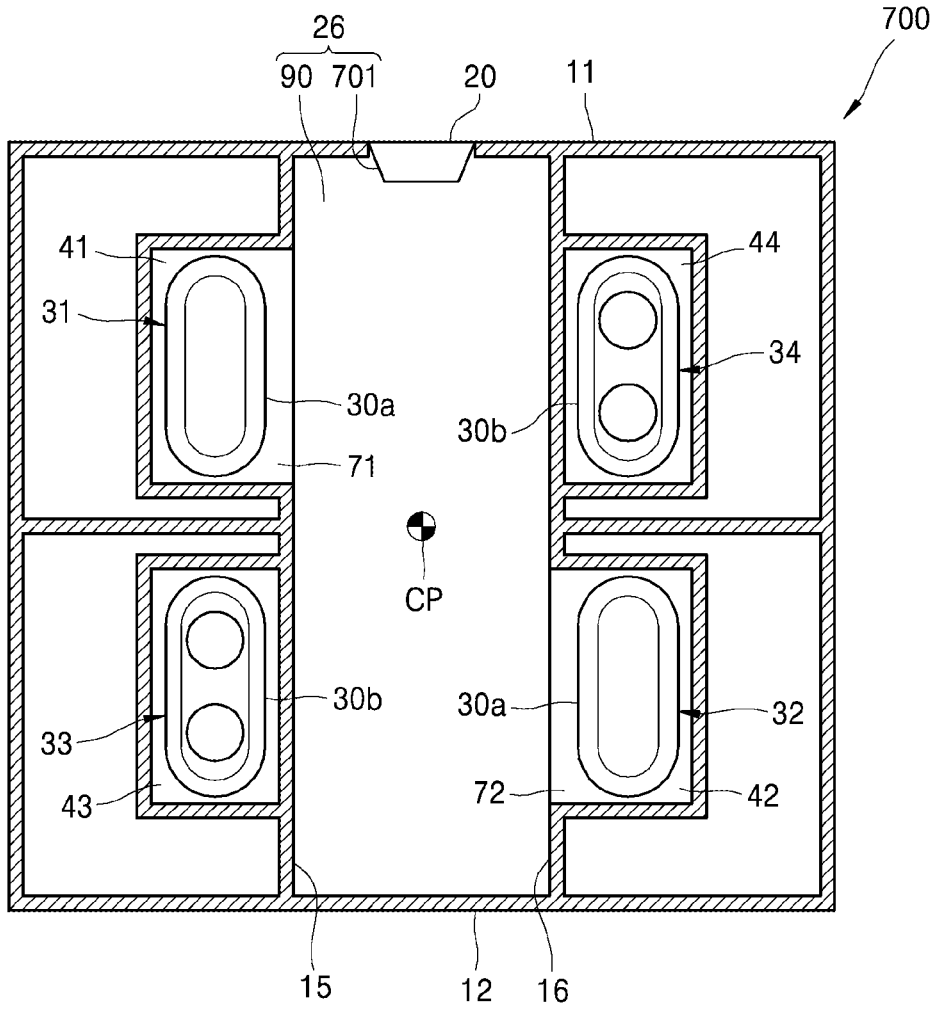
FIG. 23 is a schematic configuration diagram illustrating an example loudspeaker.

FIG. 23 is a schematic configuration diagram illustrating an example loudspeaker 700. The loudspeaker 700 according to the present example is substantially the same as the loudspeaker 1 of FIG. 2, except that a passive radiator 701 that replaces the above duct 91 forms a band-pass amplifier 26 together with a resonance chamber 90. The resonance chamber 90 and the passive radiator 701 together form a resonator. The bandwidth of sound emitted from speaker units 31 to 34 is amplified and the sound is emitted via an acoustic emission aperture 20.

If the mass of a diaphragm of the passive radiator 701 is m and the sum of a spring constant of a suspension supporting the diaphragm and a spring constant provided by air in the resonance chamber 90 is K, a resonance frequency fi of the resonator formed by the resonance chamber 90 and the passive radiator 701 may be determined using the formula $$f_1 = \frac{1}{2\pi}\sqrt{\frac{k}{m}}.$$

Thus, by appropriately determining the volume of the resonance chamber 90, the mass of the diaphragm of the passive radiator 701, and the spring constant of the suspension, sound at a desired frequency band may be amplified based on the resonant frequency fi and emitted via the acoustic emission aperture 20. Thus, an effect obtained when a Helmholtz resonator is used may be achieved. The ducts of FIGS. 14, 17, 18, 20, 21, and 22 may be also replaced with the passive radiator 701.

Figure 24:
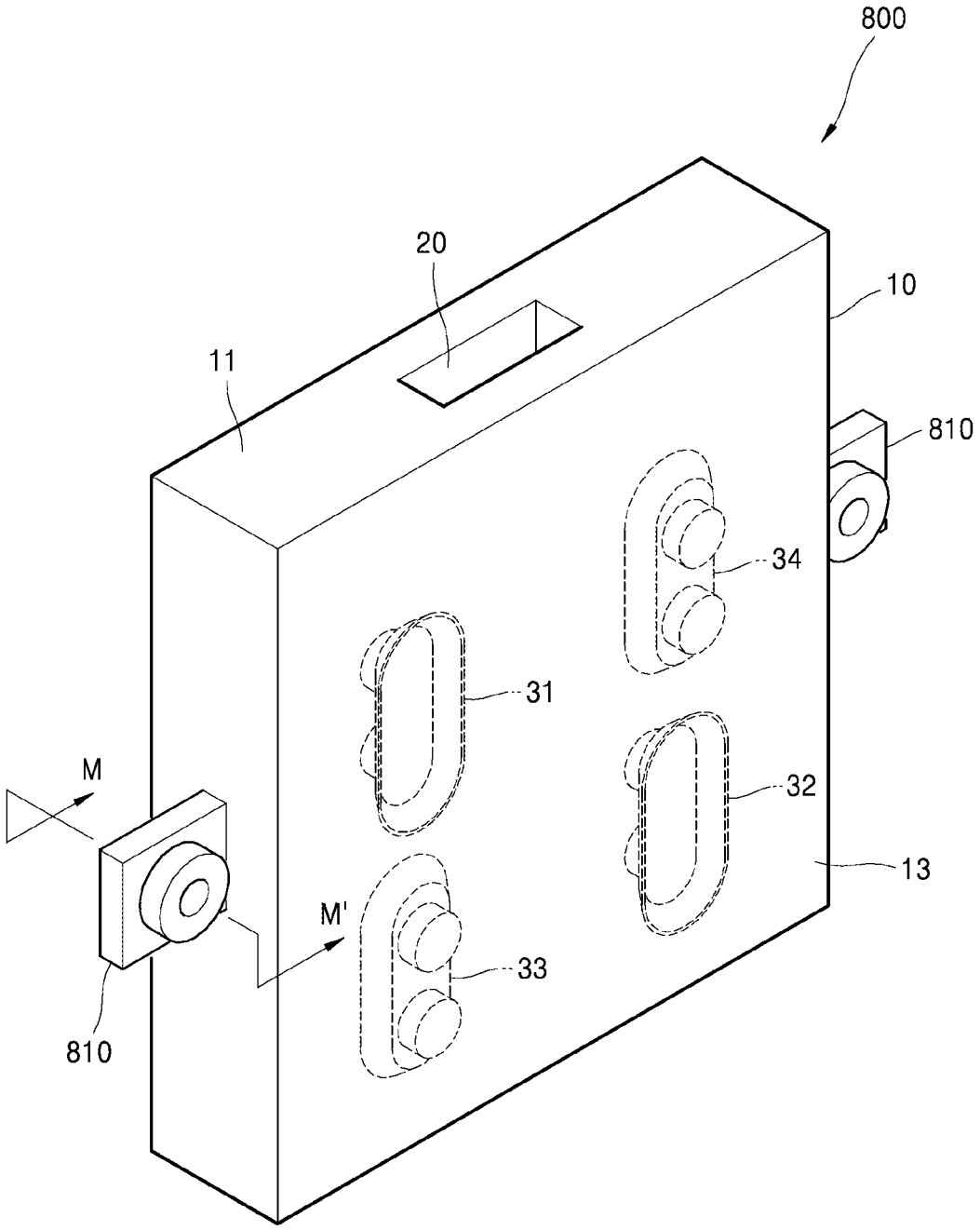
FIG. 24 is a schematic perspective view illustrating an example loudspeaker.
Figure 25:
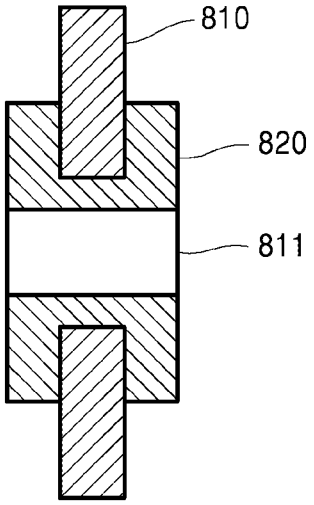
FIG. 25 is a cross-sectional view of FIG. 24, taken along line M-M'.

As described above, even if a plurality of speaker units are arranged in the non-coaxial structure, vibration occurs during an operation of a loudspeaker when both of the sum of driving forces and the sum of moments are not '0'. An electronic device in which the loudspeaker is installed may be negatively influenced by the vibration. In order to decrease the vibration, a vibration isolation structure may be provided in the loudspeaker. FIG. 24 is a schematic perspective view illustrating an example loudspeaker 800. FIG. 25 is a cross-sectional view of FIG. 24, taken along line M-M'. The loudspeaker 800 of FIG. 24 is substantially the same as the loudspeaker 1 of FIG. 1, except that a structure configured to decrease vibration is employed. Referring to FIGS. 24 and 25, in an enclosure 10, a coupling unit 810 configured to couple the loudspeaker 800 to an electronic device (not shown) is provided. For example, the coupling unit 810 may be extended to the outside of the enclosure 10. In the coupling unit 810, for example, an engagement hole 811 configured to be engaged with a screw may be provided. The loudspeaker 800 may include a vibration isolation member 820 interposed between the coupling unit 810 and the electronic device. The vibration isolation member 820 may be formed of a material having a vibration isolation property, e.g., rubber, felt, sponge, etc. The vibration isolation member 820 may be interposed between the loudspeaker 800 and the electronic device to decrease vibration to be transferred from the loudspeaker 800 to the electronic device. The vibration isolation member 820 is also applicable to a loudspeaker having the non-coaxial force-moment compensation structure.

The loudspeaker 800 according to the example embodiment is applicable to various types of electronic devices. For example, the loudspeaker 800 is applicable to display apparatuses such as flat panel TVs, monitors, etc. and slim type or small-sized electronic devices such as sound bars, etc. For example, the loudspeaker 800 may be employed as a woofer system for an electronic device.

Figure 26:
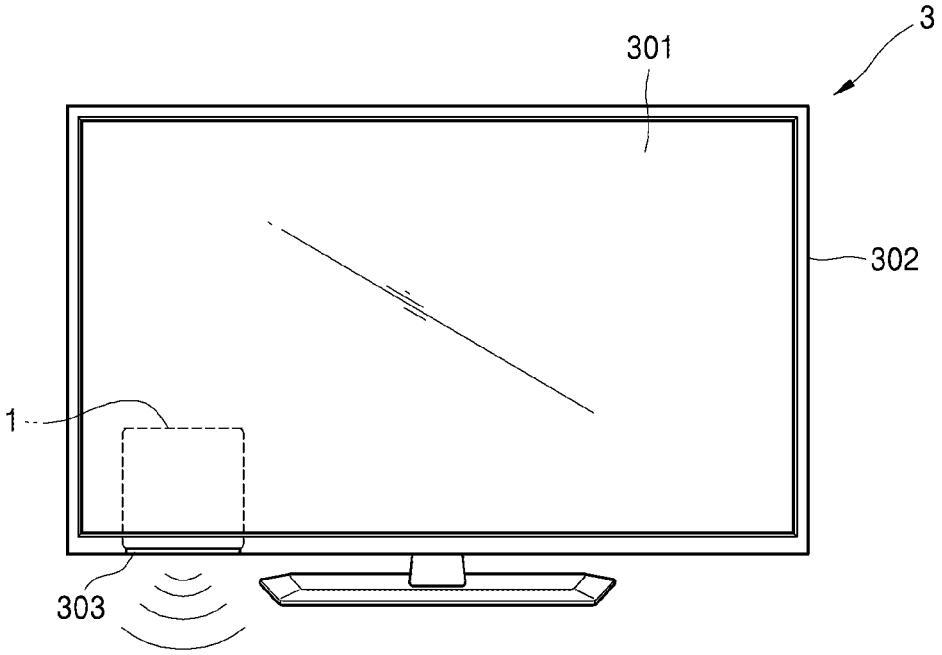
FIG. 26 illustrates an example display apparatus employing an example loudspeaker.

FIG. 26 illustrates an example display apparatus 3 employing a loudspeaker. Referring to FIG. 26, the display apparatus 3 includes a housing 302 configured to accommodate a flat panel display 301. In the housing 302, an acoustic emission aperture 303 is provided. In the housing 302, the loudspeaker 1 of FIG. 1 may be disposed.

As illustrated in FIG. 26, when a space between edges of the housing 302 and the display 301, e.g., the frame of the display apparatus 3, is thin, the acoustic emission aperture 303 may be provided in a lower or side surface of the housing 302. In the example embodiment, the acoustic emission aperture 303 is provided in the lower surface of the housing 302. The loudspeaker 1 is disposed in the housing 302 such that the upper wall 11 faces downward and the acoustic emission aperture 20 faces the acoustic emission aperture 303.

Although not shown, the acoustic emission aperture 303 may be provided in a side surface of the housing 302. In this case, the loudspeaker 1 of FIG. 1 is disposed in the housing 302 such that the upper wall 11 faces the side surface of the housing 302 and the acoustic emission aperture 20 faces the acoustic emission aperture 303.

Due to the above structure, sound may be emitted directly from the loudspeaker 1 via the acoustic emission aperture 303 without any change in a sound direction. Thus, a sound duct having a complicated structure need not be installed in the housing 302. Furthermore, the display apparatus 3 may be manufactured to have a slim structure with a smooth design, in which no aperture is formed in the front and back surfaces of the housing 303.

Figure 27:
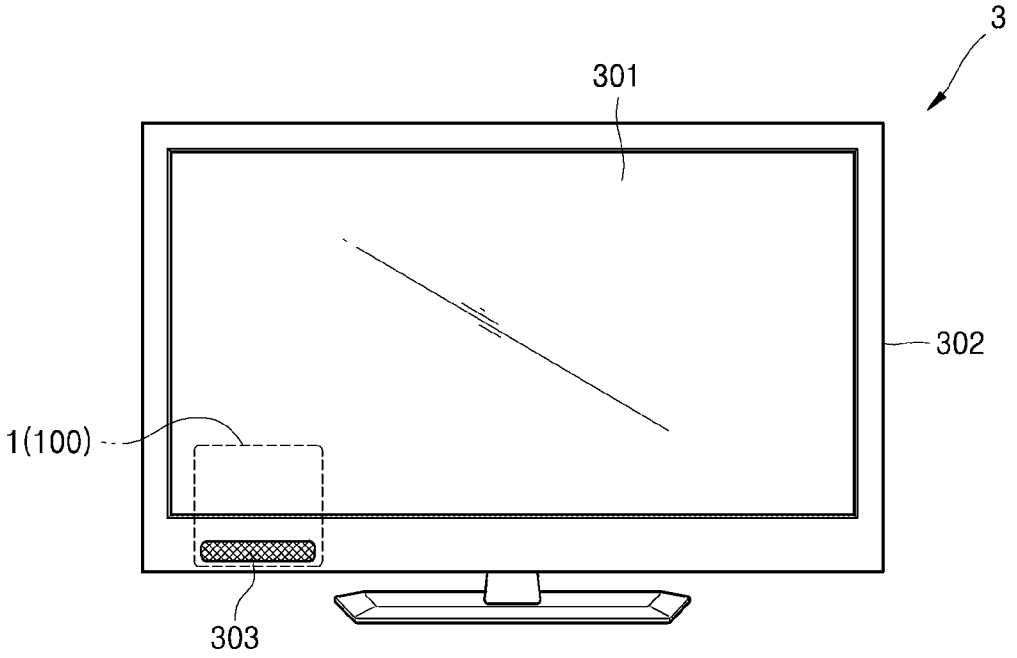
FIG. 27 illustrates an example display apparatus employing an example loudspeaker.

FIG. 27 illustrates the display apparatus 3 employing a loudspeaker according to another example embodiment. Referring to FIG. 27, the display apparatus 3 includes a housing 302 configured to accommodate a flat panel display 301. An acoustic emission aperture 303 may be provided in the housing 302. An acoustic emission aperture 303 may be formed in a front surface of the housing 302. The loudspeaker 1 of FIG. 5 or the loudspeaker 100 of FIG. 13 may be disposed in the housing 302 such that the front wall 13 or 113 faces the front surface of the housing 302 and the acoustic emission aperture 20 or the acoustic emission apertures 120*a* and 120*b* may face the acoustic emission aperture 303.

Although not shown, the acoustic emission aperture 303 is provided in a back surface of the housing 302, and the loudspeaker 1 of FIG. 5 or the loudspeaker 100 of FIG. 13 may be disposed in the housing 302 such that the front wall 13 or 113 faces the back surface of the housing 302 and the acoustic emission aperture 20 or the acoustic emission apertures 120*a* and 120*b* face the acoustic emission aperture 303.

Due to the above structure, sound may be emitted directly from the loudspeaker 1 100 via the acoustic emission aperture 303 without any change in a sound direction. Thus, the display apparatus 3 may be manufactured to have a slim structure not including a sound duct having a complicated structure and installed in the housing 302.

In the loudspeakers according to the above example embodiments, a plurality of speaker units may be employed to secure a large acoustic emission area. Since sound emitted from the plurality of speaker units are collected and emitted to the outside of an enclosure, a degree of freedom of an acoustic emission direction may be increased. The bandwidth of sound emitted from the plurality of speaker units may be band-pass amplified and the sound may be emitted to the outside of the enclosure, thereby reducing degradation in an acoustic power level. The plurality of speaker units may be arranged in the non-coaxial structure or the non-coaxial force-moment compensation structure in order to reduce vibration of the loudspeaker. Furthermore, an attenuator may be employed to improve the articulation of sound.

The loudspeakers illustrated in FIGS. 1 to 25 may function as a slim type stand-along woofer system.

Although a display apparatus is described as an example of an electronic device in the above examples, examples of the electronic device may include a personal computer (PC), a notebook computer, a mobile phone, a tablet PC, a navigation terminal, a smart phone, a personal digital assistant (PDA), a portable multimedia player (PMP), and a digital broadcasting receiver, or the like. In addition, the electronic device may be understood to include various types of apparatuses having a communication function that have been developed and put on the market or that will be developed in near future.

It should be understood that example embodiments described herein should be considered in a descriptive sense only and not for purposes of limitation. Descriptions of features or aspects within each example embodiment should typically be considered as available for other similar features or aspects in other example embodiments.

While one or more example embodiments have been described with reference to the figures, it will be understood by those of ordinary skill in the art that various changes in form and details may be made therein without departing from the spirit and scope as defined by the following claims.

What is claimed is:

1. A loudspeaker comprising:

an enclosure including a resonance chamber and a main acoustic emission aperture for communication of the resonance chamber outside the enclosure; and a plurality of speaker units, each speaker unit comprising a speaker, the plurality of speaker units including a first speaker unit of which a front side orients in a first direction and a second speaker unit of which a front side orients in a second direction opposite to the first direction, the plurality of speaker units being accommodated in the enclosure in a non-coaxial arrangement, wherein front slit spaces of the plurality of speaker units are in communication with the resonance chamber, and wherein back chambers of the plurality of speaker units are isolated from the resonance chamber and the front slit spaces of the plurality of speaker units.

2. The loudspeaker of claim 1, wherein the plurality of speaker units are arranged in a non-coaxial force-moment compensation arrangement.

3. The loudspeaker of claim 1, wherein the enclosure comprises: a first baffle in which the first speaker unit is disposed; and a second baffle in which the second speaker unit is disposed, wherein the first baffle and the second baffle form a step with respect to each other in the first direction.

4. The loudspeaker of claim 1, further comprising a duct configured to connect the resonance chamber to the acoustic emission aperture.

5. The loudspeaker of claim 1, further comprising a passive radiator installed in the acoustic emission aperture.

6. The loudspeaker of claim 1, further comprising an attenuator arranged in a plurality of communication apertures connecting the front slit spaces and the resonance chamber and configured to apply an acoustic resistance.

7. The loudspeaker of claim 1, wherein at least two of the back chambers of the plurality of speaker units communicate with each other.

8. The loudspeaker of claim 1, wherein each of the back chambers of the plurality of speaker units includes at least one of: a sealed enclosure structure, a vented enclosure structure, or a passive radiator type enclosure structure.

9. The loudspeaker of claim 1, wherein the plurality of speaker units comprise a first speaker group including speaker units arranged at one side of the resonance chamber and a second speaker group including speaker units arranged at another side of the resonance chamber, wherein back chambers of the first speaker group communicate with one another, and back chambers of the second speaker group communicate with one another.

10. The loudspeaker of claim 1, further comprising first and second acoustic emission apertures in communication with the main acoustic emission aperture, the resonance chamber comprises first and second resonance chambers, and the plurality of speaker units comprise: a first speaker group including speaker units having front slit spaces in communication with the first resonance chamber; and a second speaker group including speaker units having front slit spaces in communication with the second resonance chamber.

11. The loudspeaker of claim 10, wherein back chambers of the first speaker group communicate with one another, and back chambers of the second speaker group communicate with one another.

12. The loudspeaker of claim 10, wherein the enclosure further comprises an additional chamber configured to communicate with back chambers of the first and second speaker groups.

13. A loudspeaker comprising:

a plurality of speaker units comprising first and second speaker units, each speaker unit comprising a speaker, said plurality of speaker units arranged in a non-coaxial structure;

wherein the first and second speaker units are oriented in different first and second directions, respectively, so that a front side of the first speaker unit faces a first wall of the loudspeaker and a front side of the second speaker unit faces a second wall of the loudspeaker which is different than the first wall, and an enclosure configured to accommodate the plurality of speaker units, wherein the enclosure comprises:

an acoustic emission aperture; and a band-pass amplifier configured to communicate with front slit spaces of the plurality of speaker units, to band-pass amplify a sound emitted from the plurality of speaker units, and to emit the sound via the acoustic emission aperture.

14. The loudspeaker of claim 13, wherein the band-pass amplifier comprises:

a resonance chamber configured to communicate with the front slit spaces; and a duct configured to connect the resonance chamber and the acoustic emission aperture.

15. The loudspeaker of claim 13, wherein the band-pass amplifier comprises:

a resonance chamber configured to communicate with the front slit spaces and the acoustic emission aperture; and a passive radiator installed in the acoustic emission aperture.

16. The loudspeaker of claim 13, wherein the plurality of speaker units are disposed in a non-coaxial force-moment compensation arrangement.

17. The loudspeaker of claim 13, further comprising an attenuator disposed in a plurality of communication apertures connecting the front slit spaces and the resonance chamber and configured to apply an acoustic resistance.

18. The loudspeaker of claim 13, wherein at least two back chambers of the plurality of speaker units communicate with each other.

19. The loudspeaker of claim 13, wherein the enclosure further comprises an additional chamber configured to communicate with back chambers of the plurality of speaker units.

20. The loudspeaker of claim 13, wherein the first and second directions are opposite each other.

* * * * *